US006536866B1

(12) United States Patent
Uchikata

(10) Patent No.: US 6,536,866 B1
(45) **Date of Patent: *Mar. 25, 2003**

(54) INK JET RECOVERY SYSTEM HAVING VARIABLE RECOVERY

(75) Inventor: Yoshio Uchikata, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/671,818

(22) Filed: Jun. 25, 1996

(30) Foreign Application Priority Data

Jun. 27, 1995 (JP) ..... 7-160910

(51) Int. Cl.[7] ..... B41J 2/165
(52) U.S. Cl. ..... 347/24; 347/23
(58) Field of Search ..... 347/23, 24, 30, 347/33, 35, 43, 94

(56) References Cited

U.S. PATENT DOCUMENTS

| | | | | |
|---|---|---|---|---|
| 4,692,777 A | | 9/1987 | Hasumi | 347/23 |
| 4,977,459 A | | 12/1990 | Ebinuma et al. | 358/296 |
| 5,018,884 A | * | 5/1991 | Hirano et al. | 347/30 |
| 5,341,163 A | | 8/1994 | Hanabusa | 347/23 |
| 5,475,404 A | * | 12/1995 | Takahashi et al. | 347/23 |
| 5,495,271 A | | 2/1996 | Koitabashi et al. | 347/23 |
| 5,572,242 A | * | 11/1996 | Fuiji et al. | 347/35 |
| 5,841,448 A | * | 11/1998 | Moriyama et al. | 347/19 |
| 5,949,447 A | * | 9/1999 | Arai et al. | 347/23 |

FOREIGN PATENT DOCUMENTS

| | | | |
|---|---|---|---|
| JP | 1-221251 | 9/1989 | B41J/3/04 |
| JP | 2-122935 | 5/1990 | B41J/2/175 |
| JP | 4-250067 | 9/1992 | B41J/29/38 |

* cited by examiner

*Primary Examiner*—Judy Nguyen
(74) *Attorney, Agent, or Firm*—Fitzpatrick, Cella, Harper & Scinto

(57) ABSTRACT

An ink jet recording system includes a recovery device for maintaining and recovering performance of discharge from a plurality of discharge ports for discharging a plurality of different inks for recording, and a control device for controlling the apparatus such that a content of recovery by the recovery device for discharge ports not used for recording and a content of recovery by the recording device for discharge ports used for recording is different. The control device also controls the apparatus such that a content of recovery for a discharge port used for recording is based on whether a predetermined lapse time has passed since a previous recovery of the discharge port used for recording.

13 Claims, 19 Drawing Sheets

INK JET RECOVERY SYSTEM HAVING VARIABLE RECOVERY

BACKGROUND OF THE INVENTION

1. Field of the Invention

The present invention relates to an ink jet recovery apparatus which performs the recording by discharging the ink and a recovery method thereof, and more particularly to an ink jet recording apparatus for use as a recording system for e.g. printers, copying machines, facsimiles, word processors, electronic typewriters, computers, as well as a recovery method thereof.

2. Related Background Art

Conventionally, the ink jet recording apparatuses performs the recording on the recording medium by discharging ink droplets through the discharge ports provided within an ink jet recording head, with the ink supplied from an ink tank of e.g. cartridge type which is filled with the ink for recording to the ink jet recording head.

Such an ink jet recording apparatus has the foreign matter such as dust or bubble mixed into an ink supply system leading from an ink tank to an ink jet recording head. Since the discharge ports provided on the ink jet recording head or liquid channels in communication thereto are as small as about tens microns in inner diameter, the foreign matter such as dust or bubble, if reaching to any liquid channels, will adhere to the inner walls of liquid channels to impede the flow of ink, resulting in lower discharge efficiency of ink or reduced ink discharge responsibility to the recording signal, and in some extreme cases, clogging in discharge ports which may cause a discharge failure including ink non-discharge. Also, when the ink is not discharged for a long time while the ink remains filled in the liquid channels of the ink jet recording head, the ink constituents will be thickened, and fixed therein, resulting in a discharge failure of the ink.

Also, in the ink jet recording apparatus, if the foreign matter such as ink droplet, water droplet or dust is attached on the ink discharge port face of the ink jet recording head, the ink droplet to be discharged may be pulled by such adhering matter, resulting in deflected discharge direction or degraded image quality.

Thus, to resolve those inconveniences caused by the use of the ink, the ink jet recording apparatus is provided with a specific constitution which are not seen in other recording apparatuses, that is, a recovery system from discharge failure including means for cleaning away the ink within the liquid channels, or making the discharge port face in good conditions.

One of the recovery methods from discharge failure with the recovery system is a method for leading the new ink into the liquid channels, for example, a method of driving the discharge energy generating elements to enable discharging of the ink not directly involved in the recording to a predetermined ink acceptor (referred to as a "predischarge" or "idle discharge"). Also, there is a method of compulsorily expelling the ink through the discharge ports by exerting a predetermined pressure on the liquid channels, for example, by pressurizing an ink supply system, or sucking the ink through the ink discharge ports (referred to as a "pumping").

In addition, one of the methods of cleaning the discharge face and preventing deflection in the ink discharge direction is a method of having a wiping member for rubbing against the discharge port face to wipe the foreign matter such as ink droplet or dust adhering near the discharge ports by the relative movement of both (referred to as a "wiping").

Because the recovery operation with the recovery system as above described increases the ink consumption for other than the recording, in the conventional ink jet recording apparatuses, there have been proposed several methods, to reduce the waste of ink consumption for other than the recording, in which a plurality of carriages with recording heads mounted thereon are provided, and driven under control individually so that the recording heads mounted on the carriages not involved in the recording are not subjected to recovery operation, as described in Japanese Laid-Open Patent Application No. 1-221251, or the occurrence of discharge failure is detected, and the recovery operation is performed based on its detected result, as described in Japanese Laid-Open Patent Application No. 2-122935, or when a recovery switch is turned on, the recovery operation is performed in accordance with the history from the previous recovery operation, as described in Japanese Laid-Open Patent Application No. 4-250067.

However, the ink jet recording apparatus had a problem that when a plurality of carriages with recording heads mounted thereon are provided as in the above conventional example, a plurality of recovery systems corresponding to the carriages are required, resulting in increased costs, and the lower recording speed for the switching operation of the carriages.

Furthermore, when the recovery operation is performed, based on the result of detection of the discharge, or in accordance with the history following the previous recovery operation, the predischarge and wiping during the recording are effected for all the discharge ports of the recording heads, resulting in a problem of having increased ink consumption for the recovery operation of discharging the ink not involved in the recording.

SUMMARY OF THE INVENTION

An object of the present invention is to resolve the aforementioned problems and to provide and propose an ink jet recording apparatus, and a recovery method thereof, which performs the recording using a plurality of inks, wherein the recording is excellently effected at all times without wastefully increasing the ink consumption for the recovery operation thereof.

It is another object of the invention to provide an ink jet recording apparatus characterized by comprising recovery means for maintaining and recovering the performance of discharge from a plurality of discharge ports for discharging a plurality of different inks for the recording, and control means for controlling such that the content of recovery by said recovery means for the discharge ports for discharging the ink not used for the subsequent recording and the content of recovery by said recovery means for the discharge ports for discharging the ink used for the subsequent recording may be different.

It is another object of the invention to provide a recovery method for an ink jet recording apparatus, characterized by including a detection process of detecting whether or not a plurality of different inks will be used for the subsequent recording, and a recovery process of providing the recovery such that the content of recovery for a plurality of discharge ports for discharging each of said plurality of inks for the recording may be different for each of said plurality of inks, in accordance with the result of detection in said detection process.

An ink jet recording apparatus of the present invention with a recording method thereof to resolve the aforementioned problems comprises discriminating means for discriminating the ink involved in the recording, an ink cartridge, or a recording head, and control means for providing recovery operation for the prevention or recovery of non-discharge of the ink from the discharge ports for discharging the ink, based on the result of said discriminating means, characterized by providing control such that the ink consumption of the recovery operation for the ink, the ink cartridge or the recording head involved in the recording is lower than that of the recovery operation for the ink, the ink cartridge or the recording head not involved in the recording. Thereby, it is possible to prevent unnecessary recovery operation or wasteful ink consumption, and effect the excellent recording.

DESCRIPTION OF THE PREFERRED EMBODIMENTS

The embodiments of the present invention will be now described particularly and specifically with reference to the drawings.

FIRST EXAMPLE

Figure 1:
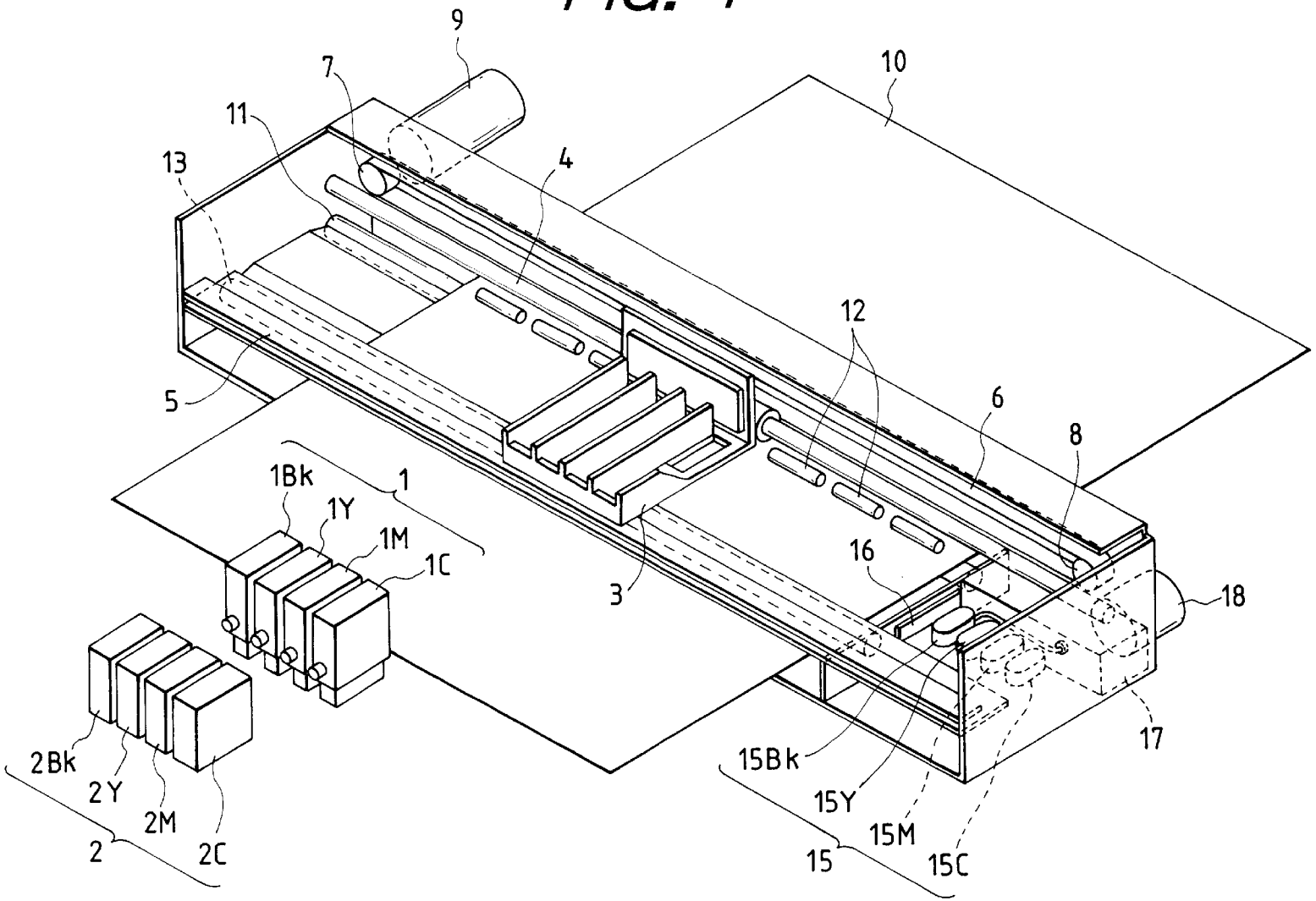
FIG. 1 is a perspective view illustrating the constitution of an ink jet recording apparatus according to a first example of the present invention.

FIG. 1 illustrates the constitution of an ink jet recording apparatus to which the present invention is applied. Herein, 1B is a BK recording head for the discharging the black (BK) ink. 1Y, 1M, 1C are a Y recording head, an M recording head, and a C recording head for the discharging the color inks of yellow (Y), magenta (M) and cyan (C), respectively. In this example, each of the recording heads has electricity-heat converters for generating heat energy for use in discharging ink provided corresponding to discharge ports. Also, 2B, 2Y, 2M and 2C are ink cartridges for supplying respective color inks to the BK recording head 1B, the Y recording head 1Y, the M recording head 1M and the C recording head 1C, respectively. The recording heads 1B, 1Y, 1M, 1C and the ink cartridges 2B, 2Y, 2M, 2C are are mounted on a carriage 3. 4 and 5 are a guide shaft and a guide rail, respectively, for guiding the movement of the carriage 3, 6 is a timing belt connected to the carriage 3 and stretched between a drive pulley 7 and an idle pulley 8, and 9 is a carriage driving motor for moving the carriage 3 via the timing belt.

10 is a recording medium (recording sheet), 11 and 12 are a sheet feed roller and a pinch roller for feeding the recording sheet 10 therebetween to the recording position, and 13 is a sheet exhaust roller for exhausting the recording sheet 10 after recording. Note that the recording is performed by discharging the inks in accordance with the recording signals from the recording heads 1BK to 1C during one scanning by the carriage 3, whereby the recording sheet 10 is fed by a sheet feed motor, not shown (as shown at 14 in FIG. 2B) each scan.

15BK, 15Y, 15M, and 15C are cap members placed at positions opposite the ink discharge port faces of recording heads 1BK, 1Y, 1M, 1C outside the recording area, 16 is a wiping member, 17 is a suction pump for the suction operation for maintaining the ink discharge function from each of the recording heads 1BK to 1C, with the ink discharge port face capped with each of the cap members 15BK, 15Y, 15M, 15C, and 18 is a recovery system motor engaged in a series of recovery operations including the suction operation. Note that the cap members 15BK to 15C and the wiping member 16 are operated by the motor 18 via a driving mechanism not shown, so that the cap members 15BK to 15C can be forcefully advanced or retracted for the capping, while the wiping member 16 is subjected to the wiping operation by movement of the carriage 3 once led to a position for wiping the ink discharge port face.

That is, the cap members 15BK to 15C, the wiping member 16 and the suction pump 17 are connected via the driving mechanism to the recovery system motor 18, wherein the cap members 15BK, 15Y, 15M, 15C and the wiping member 16 are advanced or retracted to or from the recording heads 1BK, 1Y, 1M, 1C, when driven in rotation by the recovery system motor 18, thereby effecting suction with the pump 17. Accordingly, the wiping and suction operation can be made for any of the recording heads 1BK, 1Y, 1M, 1C by controlling the carriage driving motor 9 and the recovery system motor 18.

In the vicinity of the cap members 15BK, 15Y, 15M, 15C is provided a predischarge receiver (not shown), with which the predischarge can be effected by driving the recording heads 1BK, 1Y, 1M, 1C to discharge the ink through all ink discharge ports after having moved the recording heads 1BK, 1H, 1M, 1C to the position opposite the predischarge receiver. Also, a carriage position detecting sensor 19 (see FIG. 2B) for detecting the position of the carriage 3 is provided in a movement range of the carriage 3. Also, a sheet detecting sensor 20 for detecting the presence or absence of the recording sheet 10 or its edge is provided on the course of conveying the recording sheet 10.

Figure 2:
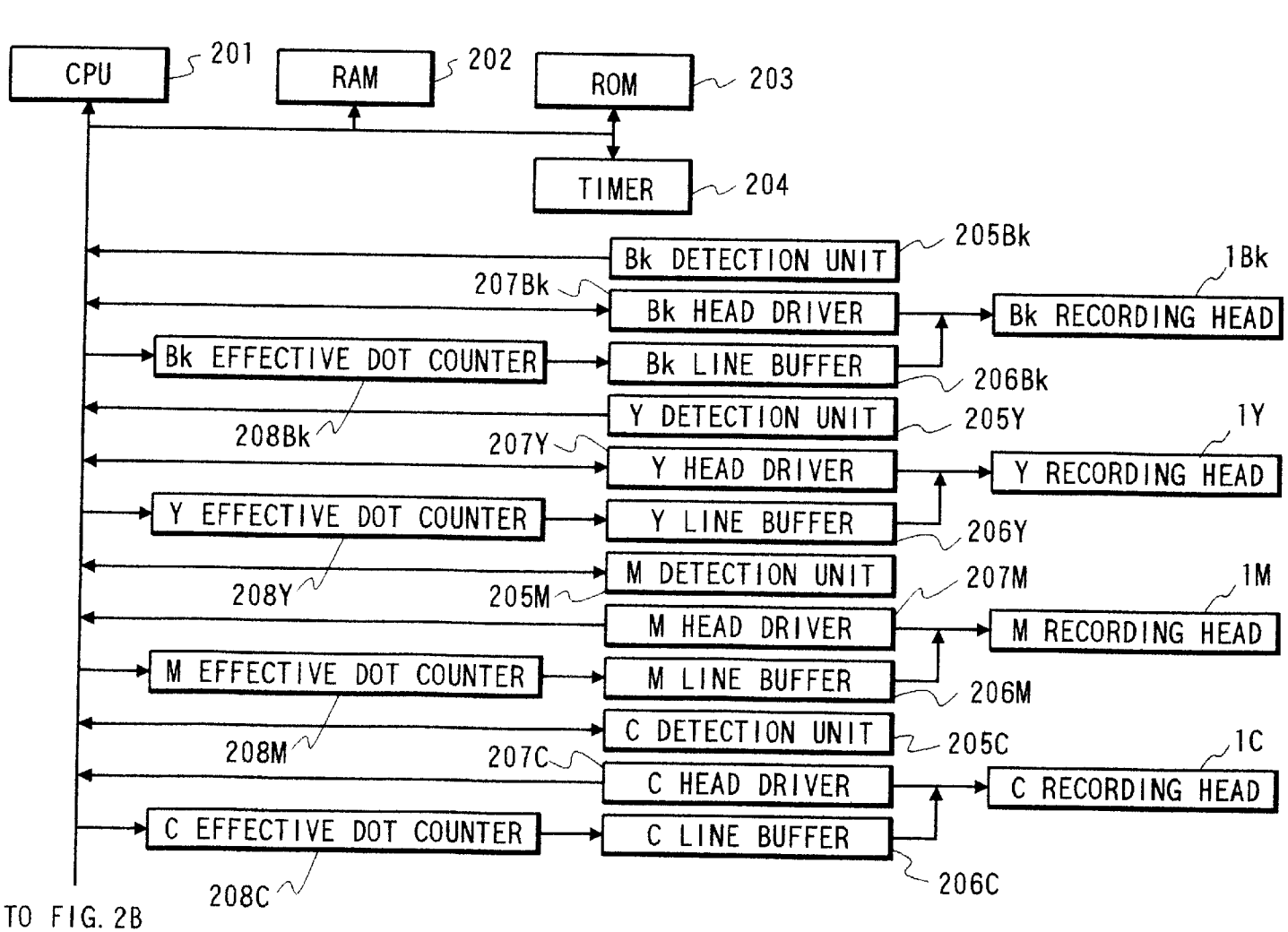
FIG. 2, composed of FIGS. 2A and 2B, is a block diagram showing the configuration of a control circuit for the ink jet recording apparatus according to the first example of the present invention.
Figure 2B:
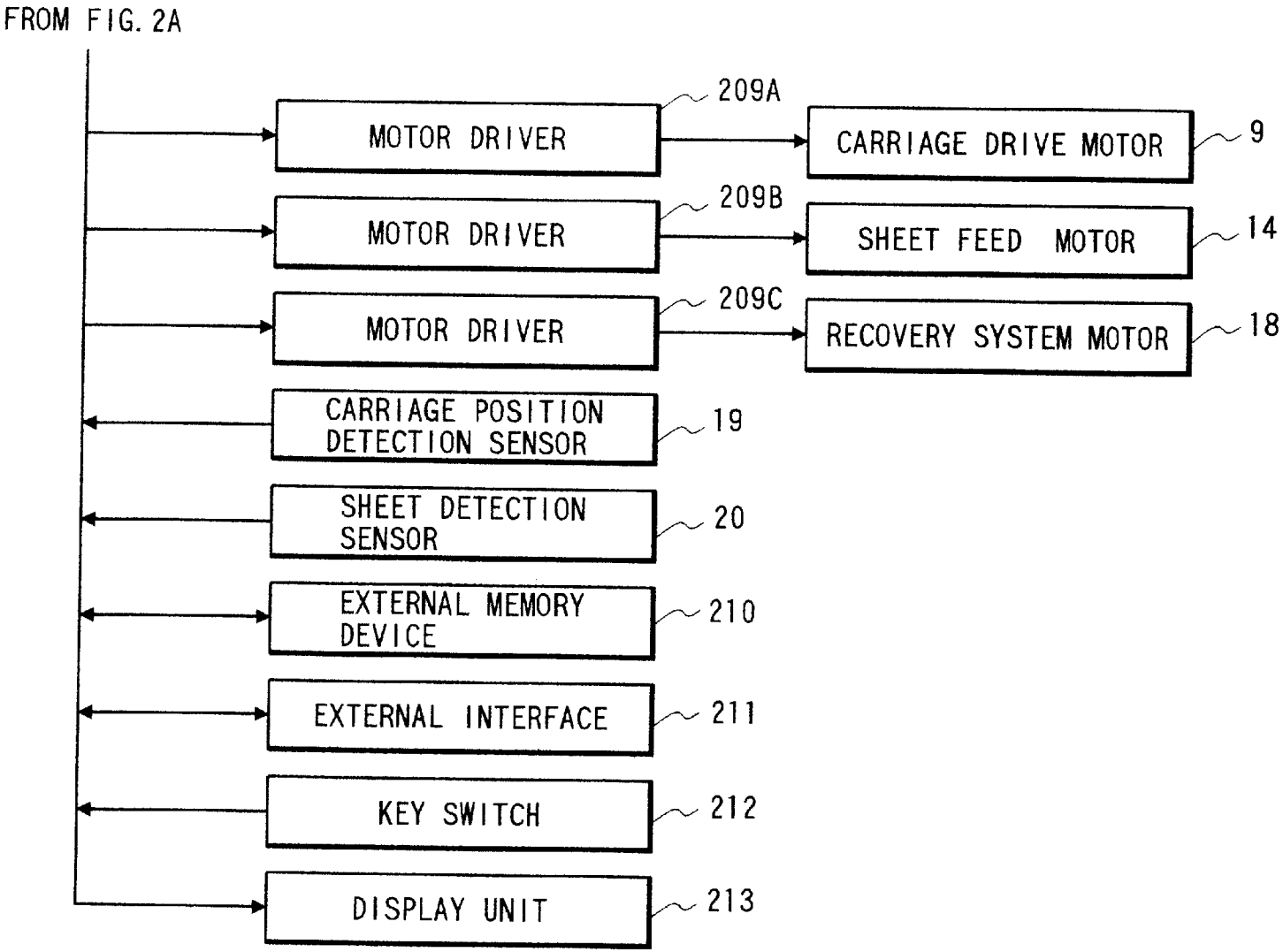

FIGS. 2A and 2B show the configuration of a control circuit for an ink jet recording apparatus of the present invention. In the same figure, 201 is a CPU, e.g. in the form of a microcomputer for performing various controls in accordance with the set procedure involving the recording, 202 is a RAM having an area for expanding the text data or image data, a storage area of various parameters, and a work area, 203 is a ROM for storing the programs corresponding to the above-mentioned procedures and fixed data such as font data, and 204 is a timer for producing the execution cycle or the timing necessary for the recording operation.

Also, 205BK is a detection unit for detecting the use of the BK recording head 1BK and its temperature, or whether the ink remains within the BK ink cartridge 2BK, 206BK is a BK line buffer for storing record data for the BK recording head 1BK, 207BK is a BK head driver for delivering a recording signal or electric power to the BK recording head 1BK, and 208BK is a BK dot counter for counting effective dots for the recording in the record data transferred to the BK line buffer 206BK.

In a similar way, for the recording heads 1Y, 1M and 1C, there are also provided a Y detection unit 205Y, a Y line buffer 206Y, a Y head driver 207Y, and a Y effective dot counter 208Y; an M detection unit 205M, an M line buffer 206M, an M head driver 207M, and an M effective dot counter 208M; and a C detection unit 205C, a C line buffer 206C, a C head driver 207C, and a C effective counter 208C.

Also, 209A, 209B, and 209C are motor drivers for delivering a signal or electric power required to drive the carriage driving motor 9, the sheet feeding motor 14, and the recovery system motor 18, respectively. Further, 210 is an external memory device such as a font card, 211 is an external interface for the communication with a host computer, not shown, 212 is a key switch for enabling various settings or operations, and 213 is a display unit for displaying the error or set state of the apparatus. Note that a power supply which is not contained in FIGS. 2A and 2B are further provided to supply the electric power to the above electrical circuit.

With the above circuit configuration, the recording can be performed on the recording sheet 10 by a printing mechanism of the ink jet recording apparatus, and its control sequence will be outlined below in accordance with the flowcharts of FIG. 3 and following figures.

Figure 3:
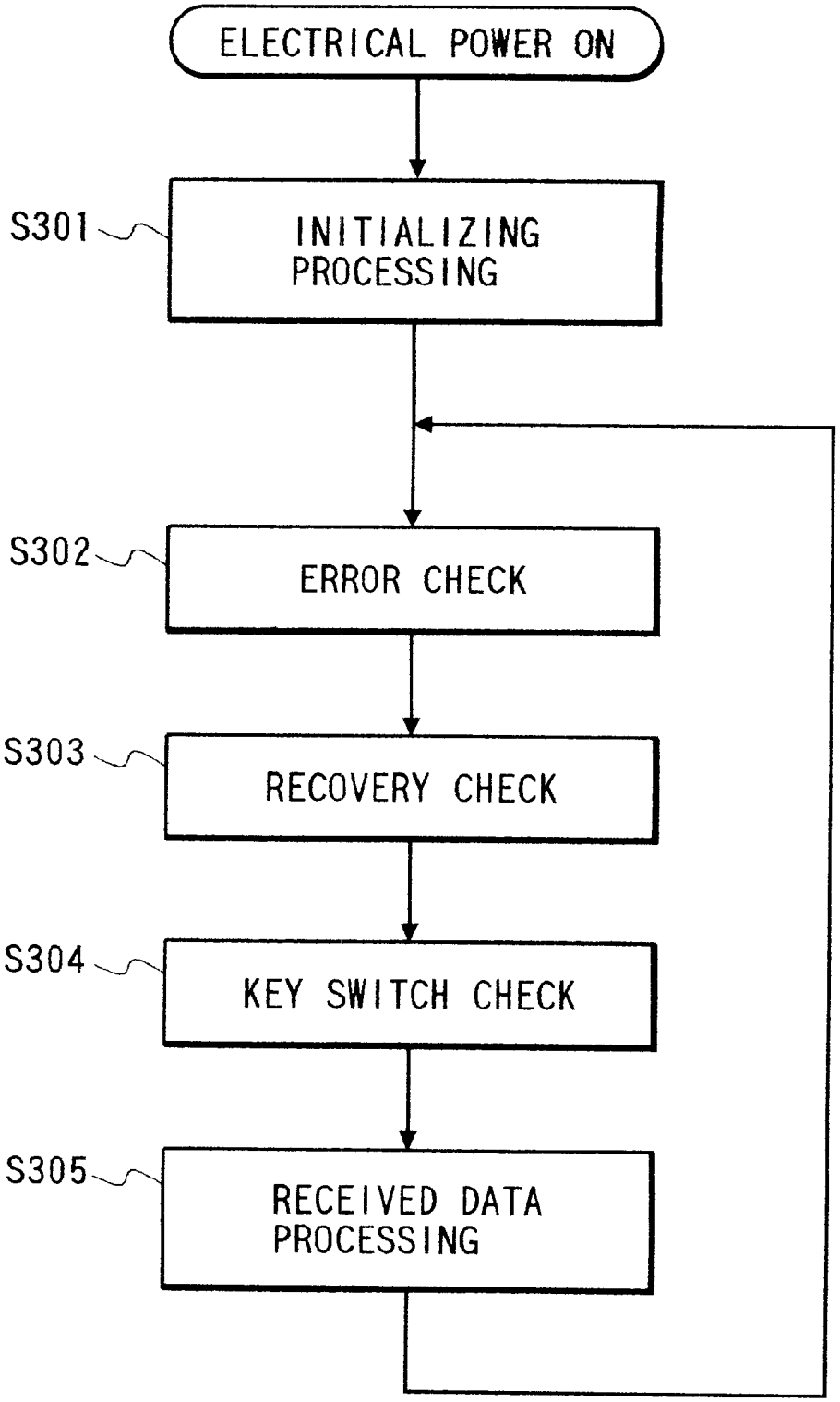
FIG. 3 is a flowchart showing the procedure of a main control for the ink jet recording apparatus according to the first example of the present invention.

FIG. 3 shows a main control of the ink jet recording apparatus according to the present invention. First, upon turning on the electric power, various initializations are performed at step S301. Then, at step S302, an error check is performed, and at step S303, a recovery check is performed. Subsequently, at S304, a key switch check is performed, and at step S305, a received data processing is carried out. And then the procedure returns to step S302, to repeat the operations from step S302 to step S305.

Figure 4:
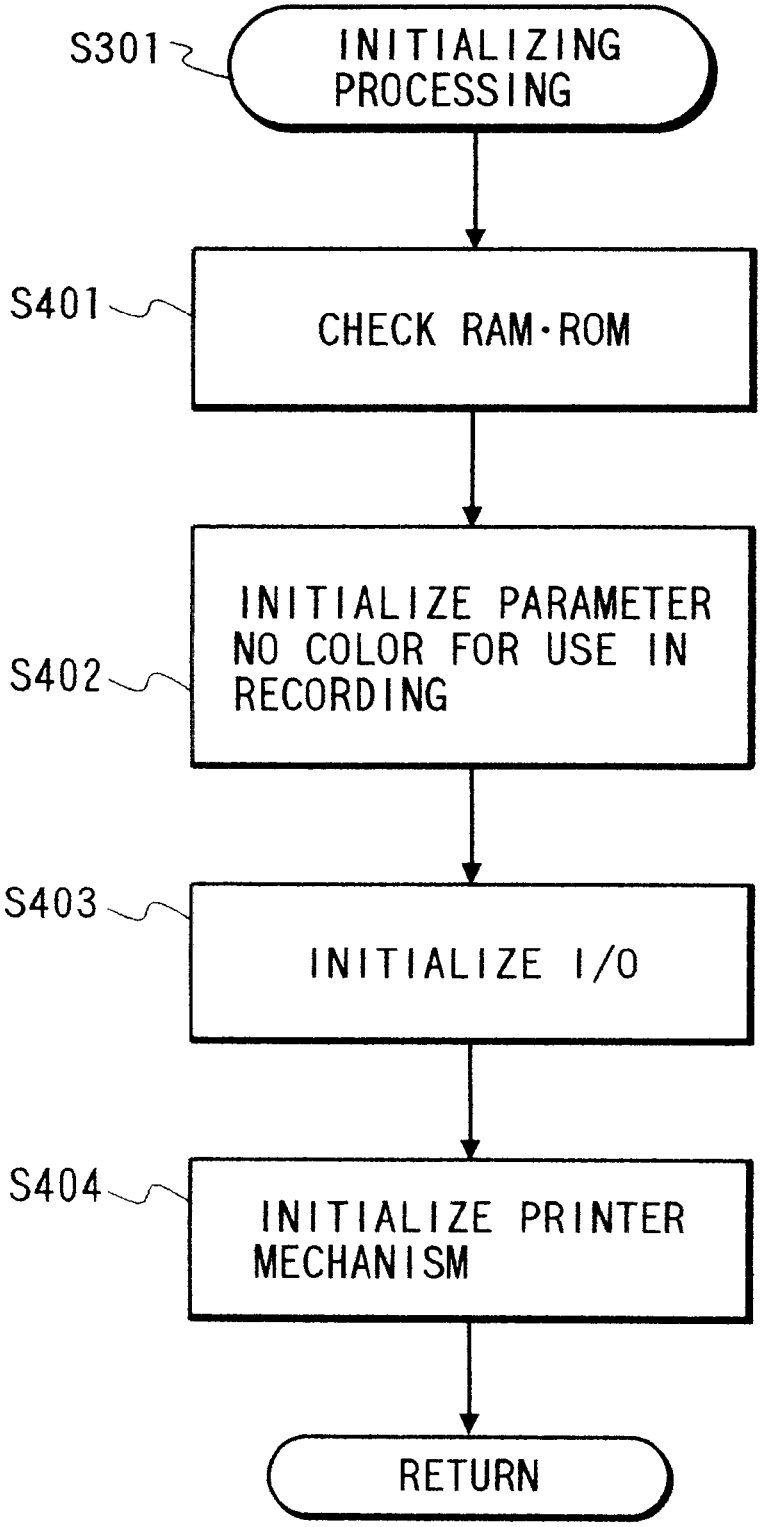
FIG. 4 is a flowchart showing the detailed procedure of an initial process as shown in FIG. 3.

FIG. 4 is a flowchart showing the details of the initial processing at step S301 as shown in FIG. 3. That is, as the detailed procedure of the initial processing S301, a check for ROM 203 and RAM 202 is made at step S401. That is, it is checked whether or not the program or data stored is normally operable. Then at step S402, various parameters are initialized. That is, every time the power supply is turned on, necessary parameters are set at predetermined values. Note that in the initialization of parameters, a flag for no color for use in current recording is set. Then at step S403, the input/output for the apparatus is initialized. Specifically, the display unit 213 and the external interface 211 are initialized. And at step S404, the mechanism for the ink jet recording apparatus is initialized. Specifically, after the initialization of ICs within the recording head 1 (1BK to 1C) and the phasing of motors, the recovery system motor 18 is driven to bring the cap members 15 (15BK to 15C) into a retracted position from the recording head 1, the carriage driving motor 9 is driven to detect switching of the carriage position detecting sensor 19 to find the position of the carriage 3, and after moving the recording head 1 to the position opposite the cap members 15, the recovery system motor 18 is driven to perform the capping for the recording head 1. Also, if any unnecessary recording sheet 10 is detected by the sheet detecting sensor 20, the recording sheet 10 is exhausted by driving the sheet feeding motor 14. In this way, this procedure is completed with the initial processing at step S404.

Figure 5:
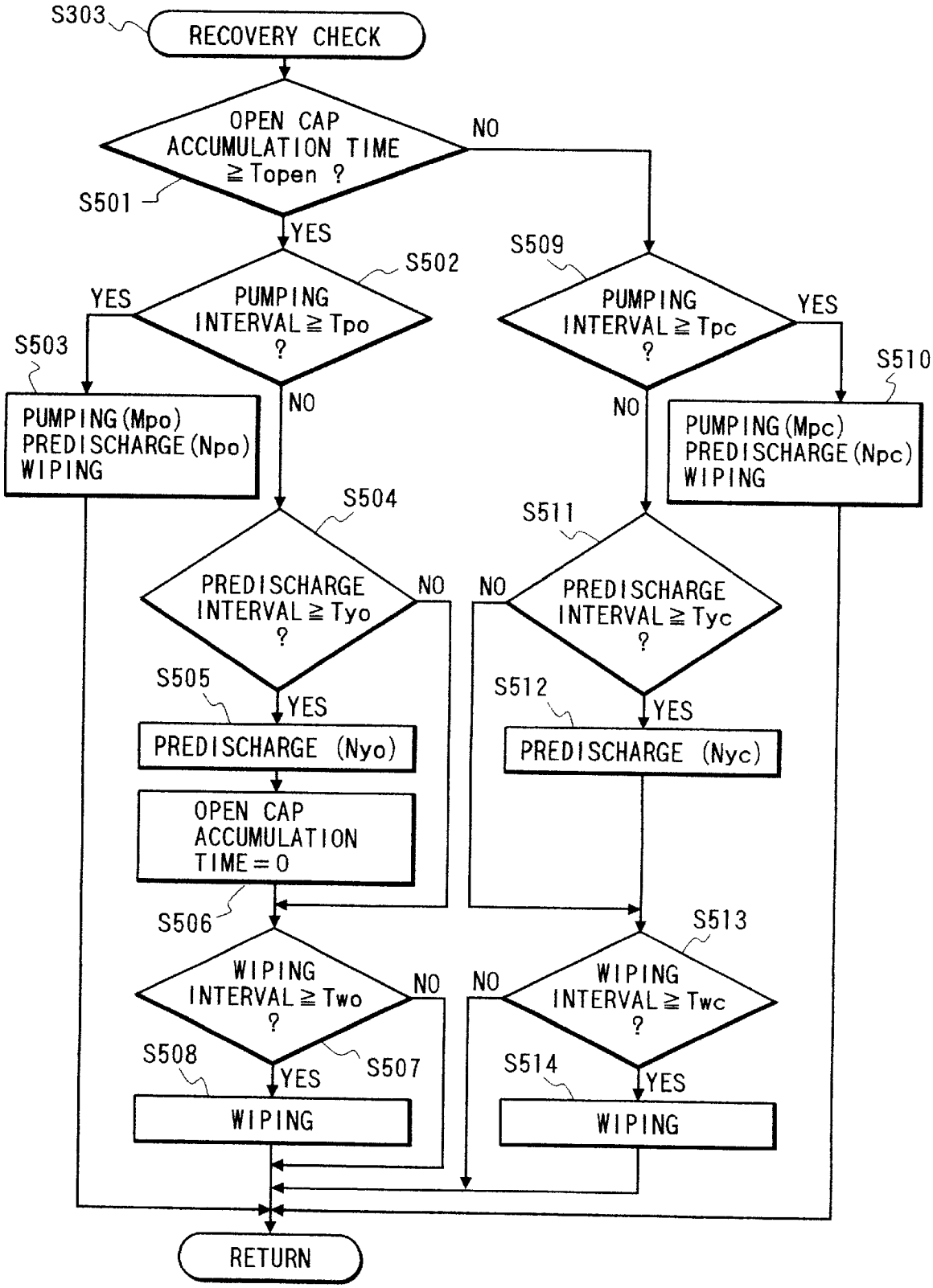
FIG. 5 is a flowchart showing the detailed procedure of a recovery check as shown in FIG. 3.

FIG. 5 shows the detailed procedure of the recovery check at step S303 involving the main control of the present invention as shown in FIG. 3. As the procedure for the recovery check at step S303, first at step S501, the open accumulation time for the cap members 15 is checked. Specifically, a determination is made whether or not the accumulation time of the recording head 1 while in a cap open state measured by the timer 204 as shown in FIGS. 2A and 2B are equal to or greater than a predetermined value Topen. This is required due to the fact that the ink discharge state of the recording head 1 is different between the cap open and closed states, wherein the ink discharge unit is opened in the cap open state, having a greater amount of ink evaporable components evaporating from the discharge ports, with more possibility that the dust sticks thereto, requiring the recovery operation at shorter intervals, than in the cap closed state. And if the result of determination at step S501 is affirmative, the procedure proceeds to step S502, where a determination is made whether or not the elapsed time from the previous pumping operation by the pump 17 for the recording head 1 is equal to or greater than a predetermined value Tpo.

Normally, the recording head 1 is devised to be capped or heat retained within the cap when not in use to suppress evaporation of the ink through the discharge ports, or prevent the discharge ports from drying through the periodical predischarges, but when left away for the very long time, the ink within the ink flow passageways leading from the ink cartridges 2 (2BK to 2C) to the recording head 1 will evaporate through the wall faces, producing more air bubbles within the ink flow passageways, possibly resulting in a discharge failure. Note that to recover from the discharge failure, it is effective to compulsorily suck (pump) the ink through the discharge ports of the recording head 1. Thus, if the result of determination at step S502 is affirmative, the pumping is determined to be required, the procedure proceeds to step S503, where the pumping by a predetermined amount of ink Mpo and the predischarge by a predetermined amount of ink Npo are performed, and then the wiping is carried out, and is ended.

Also, if the result of determination at step S502 is negative, the procedure proceeds to step S504 to determine whether or not the elapsed time from the previous predischarge is equal to or greater than a predetermined value Tyo. If the recording head 1 is not used for the long time, the viscosity of the ink near the discharge ports rises due to evaporation of the ink through the discharge ports of the recording head 1, causing a discharge failure. And in such cases, to recover from the discharge failure, the predischarge from the recording head 1 can be effectively performed. Thus, if the result of determination at step S504 is affirmative, the predischarge is determined to be required, and the procedure proceeds to step S505. At step S505, the predischarge by a predetermined amount of ink Nyo is performed, and then at step S506, the open cap accumulation time is cleared. Also, if the result of determination at step S504 is negative, the steps S505, S506 are bypassed, and the procedure proceeds directly to step S507. Thus, at step S507, a determination is made whether or not the elapsed time from the previous wiping is equal to or greater than a predetermined value Two.

Due to the ink discharge from the recording head 1 and the movement of the recording head 1 relative to the recording sheet 10, the ink mist, paper powder or dust may adhere onto the ink discharge face of the recording head 1, causing a discharge failure or deviated discharge direction. In such cases, to recover from the discharge failure or deviated discharge direction, the wiping of the recording head 1 is effective. Thus, if the result of determination at step S507 is affirmative, the wiping is determined to be required. And at step S508, the wiping is executed, and then the procedure is ended. Note that if the result of determination at step S507 is negative, the step S508 is bypassed, and the procedure is ended.

Also, if the result of determination at step S501 is negative, the procedure proceeds to step S509 to determine whether or not the elapsed time from the previous pumping by the pump 17 for the recording head 1 is equal to or greater than a predetermined value Tpc. If the result of determination at step S509 is affirmative, the pumping is determined to be required. And at step S510, the pumping by a predetermined amount of ink Mpc and the predischarge by a predetermined amount of ink Npc are performed, then the wiping is executed, and the procedure is ended. If the result of determination at step S509 is negative, the procedure proceeds to step S511 to determine whether or not the elapsed time from the previous predischarge is equal to or greater than a predetermined value Tyc.

If the result of determination at step S511 is affirmative, the predischarge is determined to be required, and the procedure proceeds to step S512 to effect predischarge by a predetermined amount of ink Nyc, and then the procedure proceeds to step S513. Also, if the result of determination at step S511 is negative, the step S512 is bypassed, and the procedure proceeds to step S513 to determine whether or not the elapsed time from the previous wiping is equal to or greater than a predetermined value Twc. If the result of determination at step S513 is affirmative, the wiping is determined to be required, and the procedure proceeds to step S514 to effect wiping, and is ended. Also, if the result of determination at step S513 is negative, the step S514 is bypassed, and the procedure is ended.

Note that for the recovery check S303 as above described, the distinction between ink colors is not made for the simplicity of explanation, but the recovery check procedure is performed separately for each ink color, that is, the recovery operation comprised of pumping, predischarge, and wiping are determined and performed under control independent for each of the recording heads 1BK, 1Y, 1M, 1C. Thus, for the recovery check S303, the optimal recovery operation can be effected in accordance with the history of each recording head 1.

Figure 6:
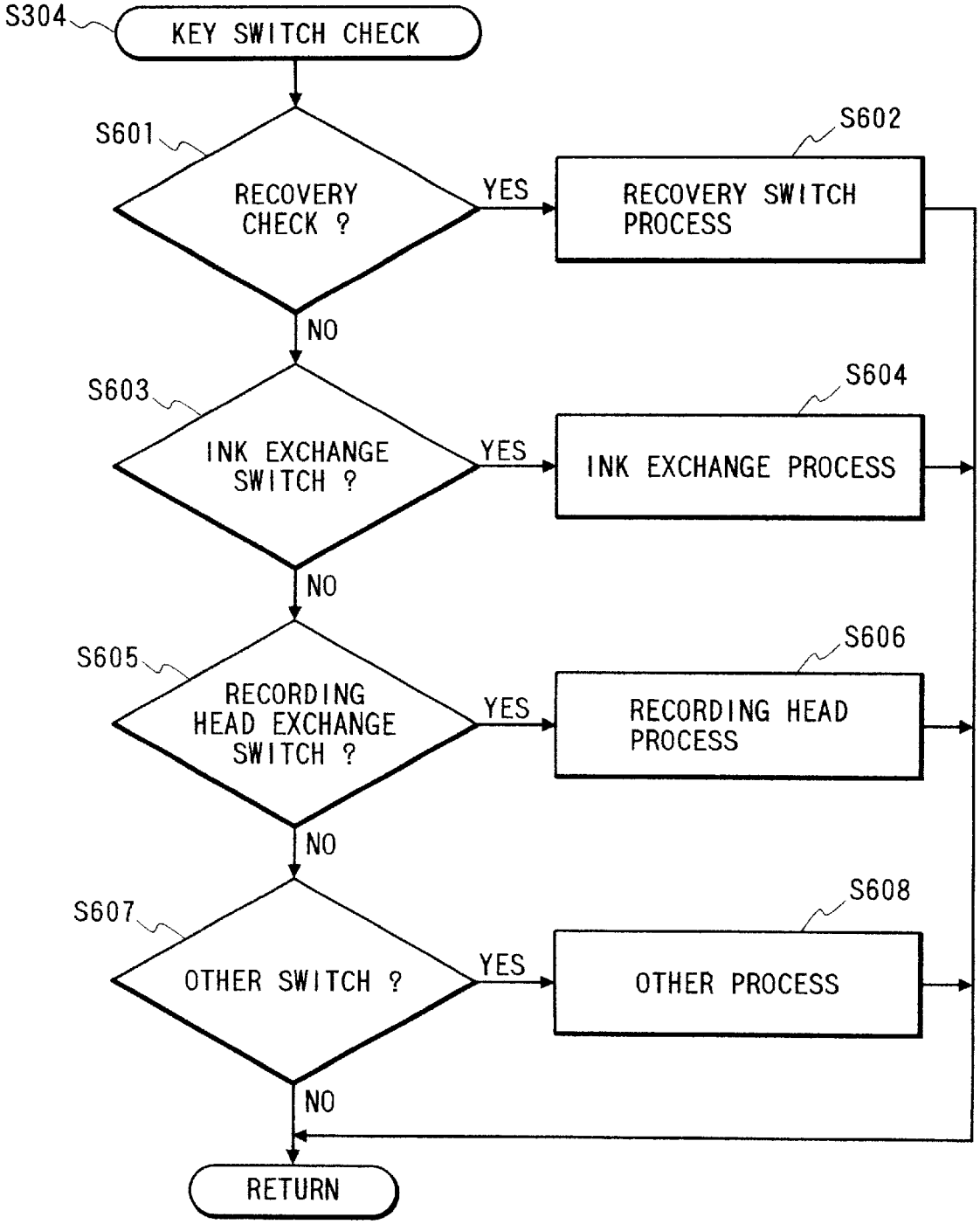
FIG. 6 is a flowchart showing the detailed procedure of a key switch check as shown in FIG. 3.

FIG. 6 shows the detailed procedure of key switch check at step S304 as shown in FIG. 3. For the key switch check S304, a determination is first made at step S601 whether or not a recovery switch is operated. If the result of determination at step S601 is affirmative, the procedure proceeds to step S602 for the recovery switch process, and then is ended. Also, if the result of determination at step S601 is negative, the procedure proceeds to step S603 to determine whether or not an ink exchange switch is operated. If the result of determination at step S603 is affirmative, the procedure proceeds to step S604 for the process for ink exchange, or specifically, to move the carriage 3 to an exchange position to check for an exchange of the ink cartridge 2, and perform the recovery operation for a new ink cartridge after the ink cartridge is exchanged, i.e., the pumping and predischarge by an adequate amount of ink, and the wiping, and the procedure is ended.

Also, if the result of determination at step S603 is negative, the procedure proceeds to step S605 to determine whether or not the recording head exchange switch is operated. If the result of determination at step S606 is affirmative, the procedure proceeds to step S606 for the recording head exchange process, or specifically, to move the carriage 3 to the exchange position, check for an exchange of the recording head 1, and perform the recovery operation for a new recording head 1 after the recording head is mounted, i.e., the pumping and predischage by an adequate amount of ink, and the wiping, and the procedure is ended.

Also, if the result of determination at step S605 is negative, the procedure proceeds to step S607 to determine whether or not other switches are operated. If the result of determination at step S607 is affirmative, the procedure proceeds to step S608 to perform a process for other switches, or specifically, make setting of recording parameters, feed and supply of the recording sheet, line feed, exhaust, and interruption of recording, and is ended.

While in the key switch check S304, the process corresponding to the key switch 212 was involved, it is needless to say that when the command is input from the external interface 211 or the information device is integrally provided, the similar process can be also performed upon an input from the display unit 213.

Figure 7:
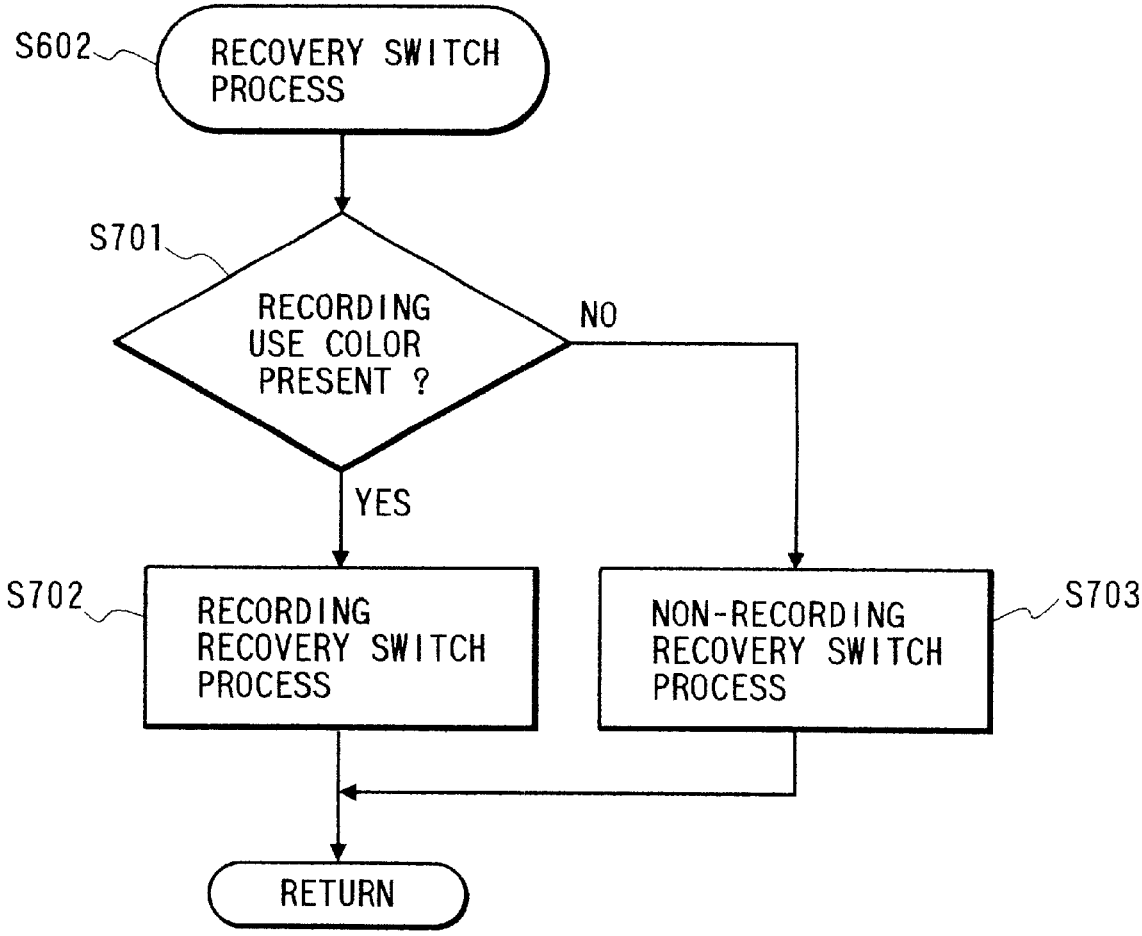
FIG. 7 is a flowchart further showing the detailed procedure of a recovery switch process as shown in FIG. 6.

FIG. 7 further shows the detailed procedure of recovery switch process according to the present invention at step S602 as shown in FIG. 6. That is, for the step S602 for recovery switch process, a determination is first made at step S701 whether or not there remains the ink being currently used for recording. And if the result of determination at step S701 is affirmative, it is determined that there occurs the inconvenience in discharging the ink being used, and the procedure proceeds to step S702 to effect a recording recovery switch process for the recording head discharging the ink, and is ended. Also, if the result of determination at step S701 is negative, the procedure proceeds to step S703 to effect a non-recording recovery switch process for the recording head 1, and then is ended.

Figure 8:
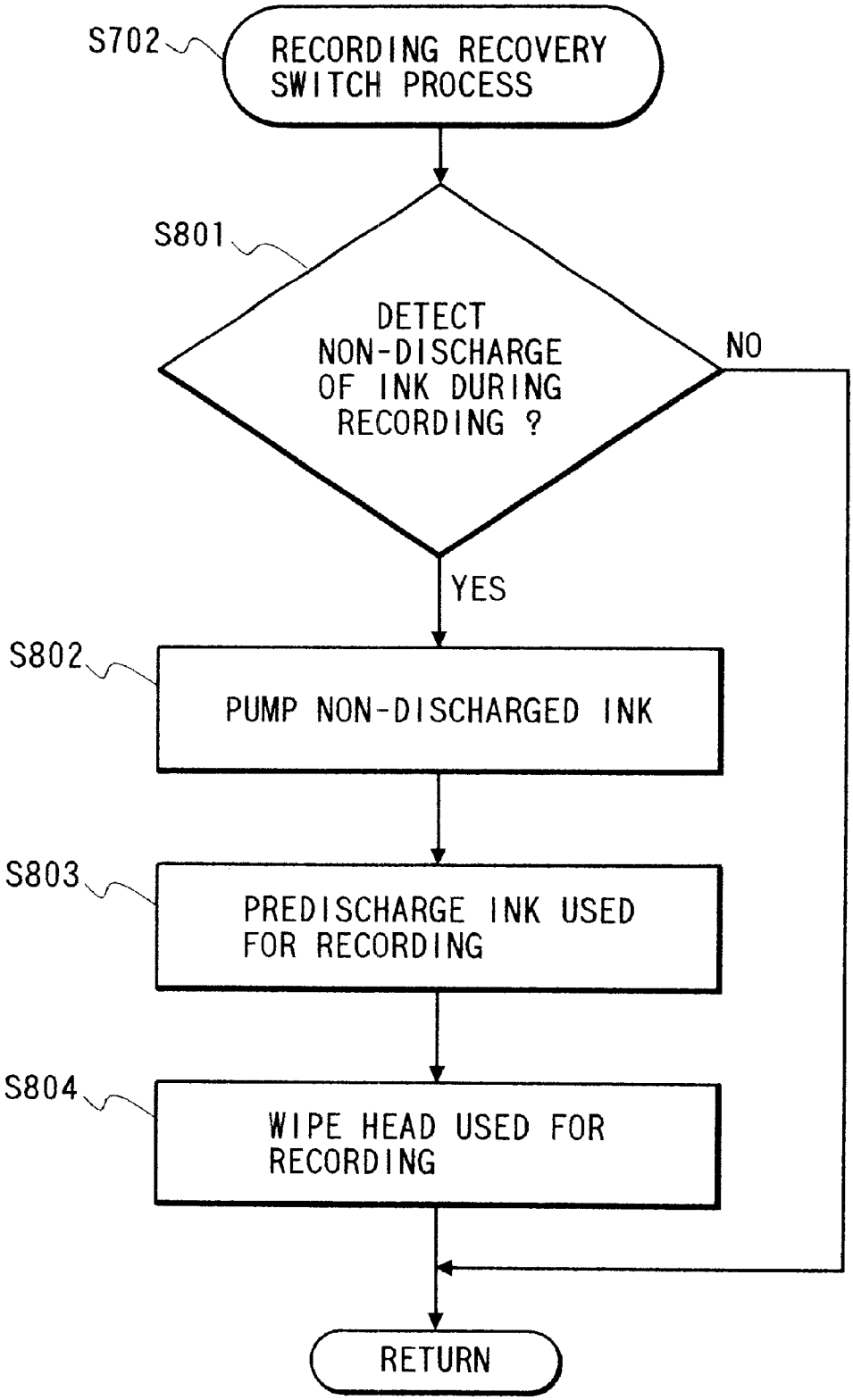
FIG. 8 is a flowchart further showing the detailed procedure of a recording recovery switch process as shown in FIG. 7.

Referring to FIG. 8, the detailed procedure of the recording recovery switch process at step S702 as shown in FIG. 7 is described.

First, it is detected at step S801 whether or not there occurs a discharge failure for the ink being currently used for the recording. Specific means for detecting the discharge failure may be any well-known means. As an example, means for detecting the flying ink droplet discharged from each of discharge ports may be conceived. Note that unless any non-discharge is detected, this process is ended. Also, if any non-discharge is detected, the procedure proceeds to the next step S802 to pump the non-discharged ink which has been determined as the discharge failure as a result of detection at step S801. Then, the procedure proceeds to step S803 to predischarge the ink being used for the recording, and to step S804 to wipe the recording head 1 used for the recording, and then the procedure is ended. Note that this procedure is performed for all the recording heads 1 being used in discharging the ink.

Owing to such recording recovery switch process S702, the recovery operation from the non-discharge which has occurred during recording can be securely effected without consuming wastefully the ink not involved in the recording upon the recovery operation.

Figure 9:
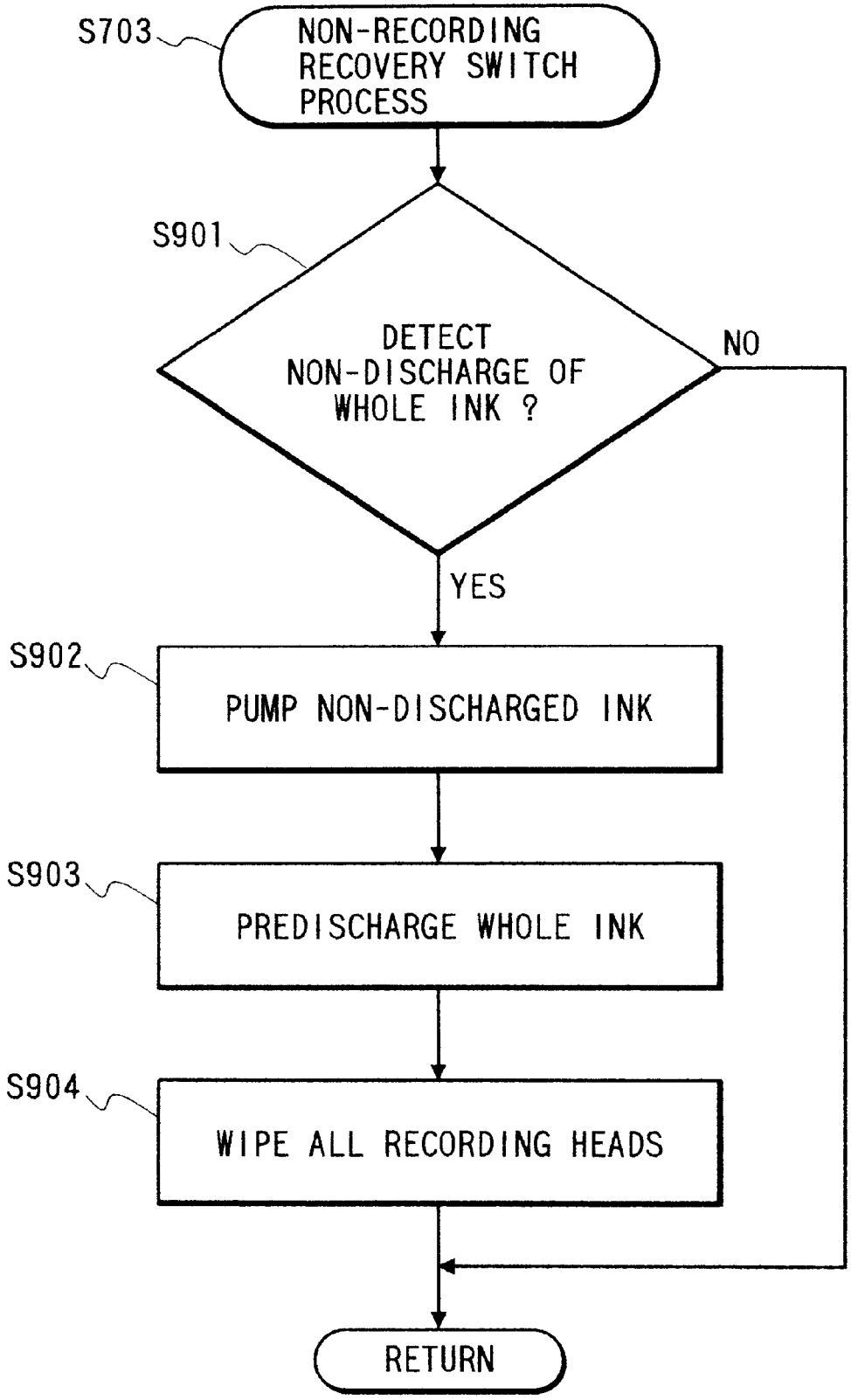
FIG. 9 is a flowchart further showing the detailed procedure of a non-recording recovery switch process as shown in FIG. 7.

FIG. 9 shows the detailed procedure of the non-recording recovery switch process at step S703 as shown in FIG. 7.

In the procedure for the non-recording recovery switch process S703, first at step S901, the non-discharge for all the recording heads 1BK to 1C is detected. Herein, if it is determined that the non-discharge for all the recording heads 1BK to 1C does not exist, this procedure is ended. Also, if the result is affirmative, the procedure proceeds to the next step S902 to effect pumping of the recording head which has been determined as the non-discharge as a result of detection at step S901. Then at step S903, the predischarge for all the recording heads 1BK to 1C is performed. At step S904, the wiping for all the recording heads 1 is performed, and the procedure is ended.

Figure 10:
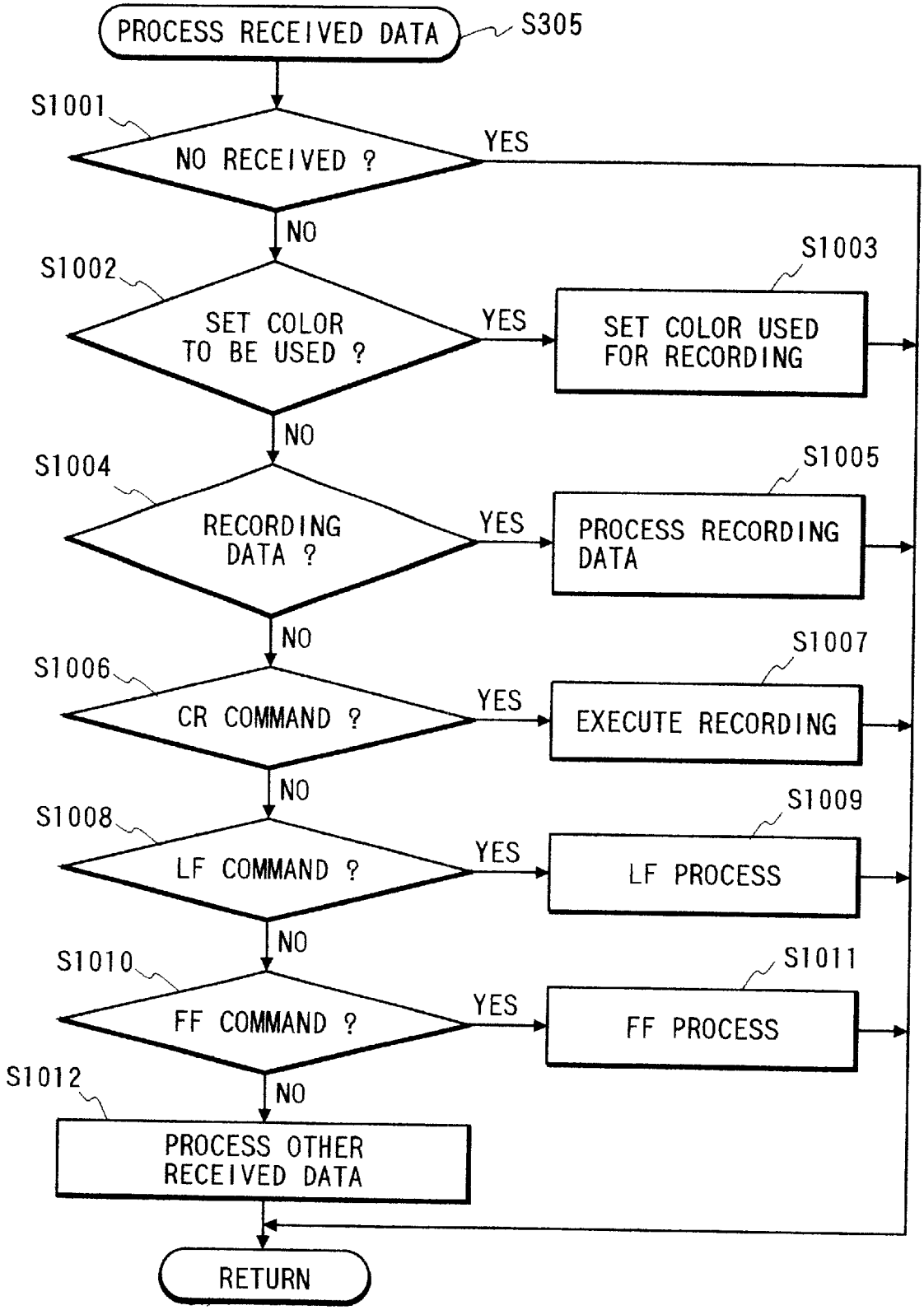
FIG. 10 is a flowchart showing the detailed procedure of a received data process as shown in FIG. 3.

FIG. 10 shows the detailed procedure of received data process at step S305 as shown in FIG. 3.

First, at step S1001, a determination is made whether or not there is received data from the external interface 211. If the result of determination at step S1001 is affirmative, that is, no received date, this processing is ended. If the result of determination at step S1001 is negative, that is, received data present, the procedure proceeds to step S1002 to determine whether or not the received data is a command for setting the color for use in recording. If the result of determination at step S1002 is affirmative, the procedure proceeds to step S100 to set (store) the color for use in recording, and is ended. Also, if the result of determination at step S1002 is negative, the procedure proceeds to step S1004 to determine whether or not received data is recording data. And if the result of determination at step S1004 is affirmative, the procedure proceeds to step S1005 to process the recording data, and is ended. Specifically, the recording data is transferred to the line buffers 206BK, 206Y, 206M, 206C corresponding to the recording colors.

Also, if the result of determination at step S1004 is negative, the procedure proceeds to step S1006 to determine whether or not the received data is a CR command (code). If the result of determination at step S1006 is affirmative, the procedure proceeds to step S1007 to process recording data in accordance with its command, and is ended. Also, if the result of determination at step S1006 is negative, the procedure proceeds to step S1008 to determine whether or not received data is an LF command (code). And if the result of determination at step S1008 is affirmative, the procedure proceeds to step S1009 to execute LF processing, and is ended. Also, if the result of determination at step S1008 is negative, the procedure proceeds to step S1010 to determine whether or not the received data is an FF command (code). And if the result of determination at step S1010 is affirmative, the procedure proceeds to step S1011 to execute FF processing, and is ended. Also, if the result of determination at step S1010 is negative, the procedure proceeds to step S1012 to process other received data, and is ended.

Figure 11:
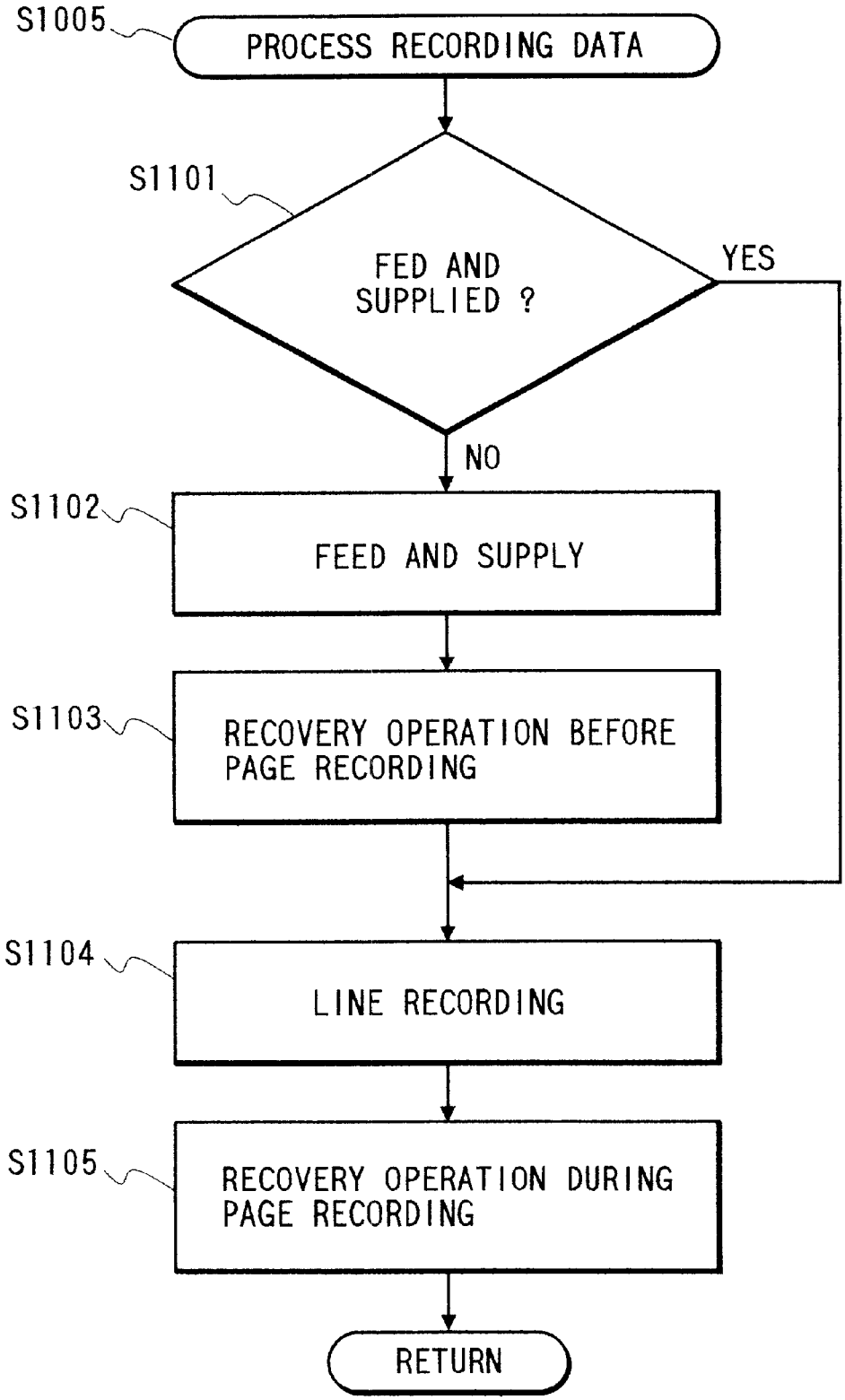
FIG. 11 is a flowchart further showing the detailed procedure of a recording data process as shown in FIG. 10.

FIG. 11 shows the detailed procedure of recording data process at step S1005 as shown in FIG. 10. As the procedure of the recording data process S1005, first at step S1101, a determination is made whether or not the sheet has been fed and supplied. If the result of determination at step S1101 is negative, or the sheet has not been fed and supplied, the procedure proceeds to step S1102 to feed and supply the sheet. In this example, automatic feed and supply means is omitted, but the feed and supply can be effected by well-known techniques. At step S1103, the recovery processing before the start of page recording is executed, and the procedure proceeds to step S1104, but if the result of determination at step S1101 is affirmative, the procedure proceeds directly to step S1104 by bypassing the steps S1102 and S1103. Thus, line recording is performed at step S1104. Specifically, the recording data within the line buffer 206 is transferred to the recording head 1 to enable a head driver 207 to perform the recording by discharging the ink from the recording head 1 onto the recording sheet 10, while the carriage drive motor 9 is driven to move the carriage 3 along the guide shaft 12. And at step S1105, the recovery process during page recording is executed at step S1105, and the processing is ended.

Figure 12:
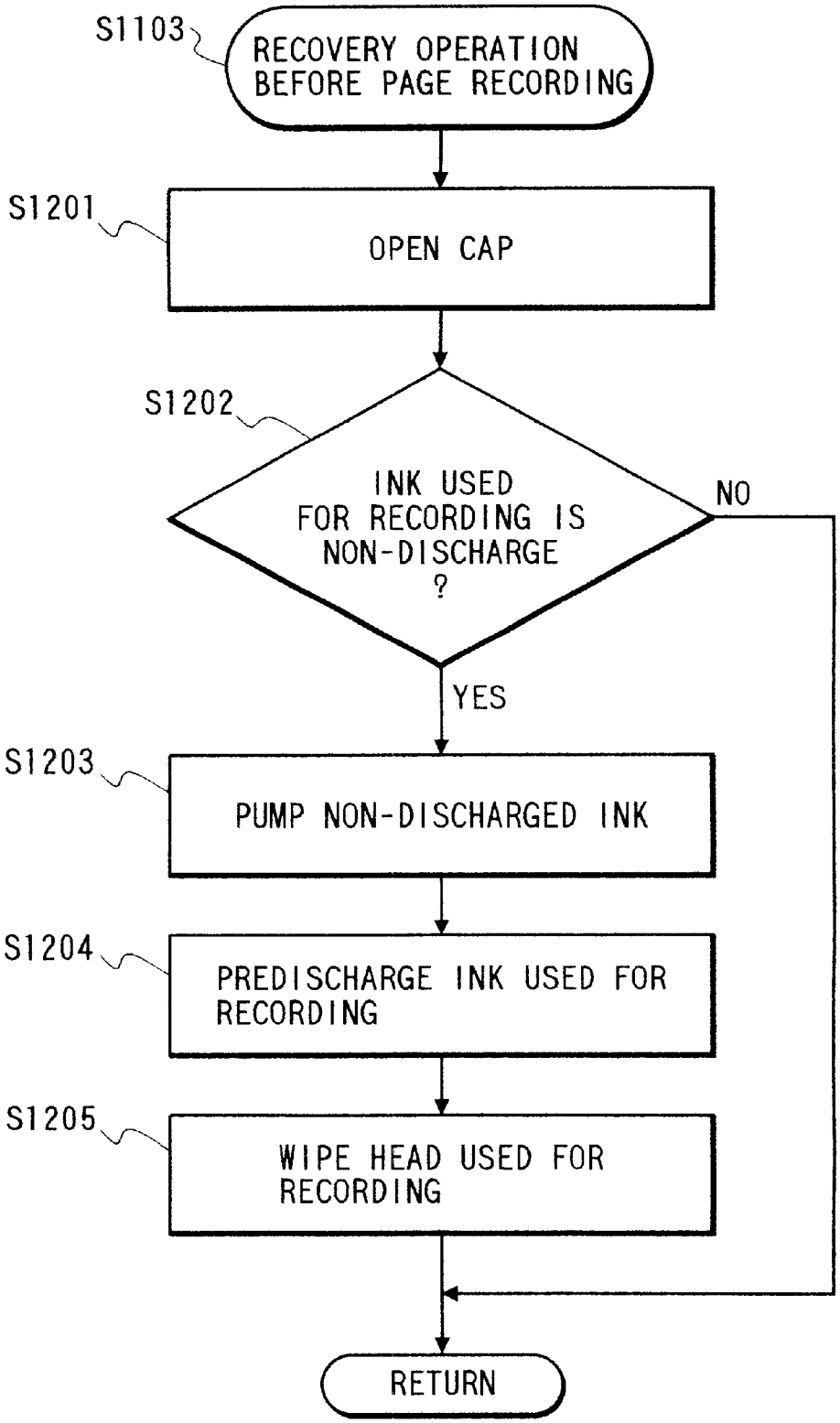
FIG. 12 is a flowchart showing the detailed procedure of a recovery operation before page recording as shown in FIG. 11.

FIG. 12 shows the detailed procedure of recovery process before page recording at step S1103 as shown in FIG. 11. This procedure first opens the cap member 15 of the recording head 1 at step S1201. Note that in this example, the cap member 15 is opened and sealed in a unit of page. Then, at step S1202, a determination is made whether or not the recording head discharges none of the ink being currently used for recording. And if the answer is affirmative, or the non-discharge, the procedure proceeds to step S1203 to pump the recording head 1 for the ink which has been determined as the non-discharge as a result of determination at step S1202. Then, at step S1204, the predischarge is performed for the ink being used for recording. At step S1205, the wiping of the recording head 1 in use for recording is performed, and the processing is ended.

Owing to such recovery process before page recording S1103, the ink discharge before page recording can be retained in good conditions without consuming wastefully the ink not involved in recording upon the recovery operation.

Figure 13:
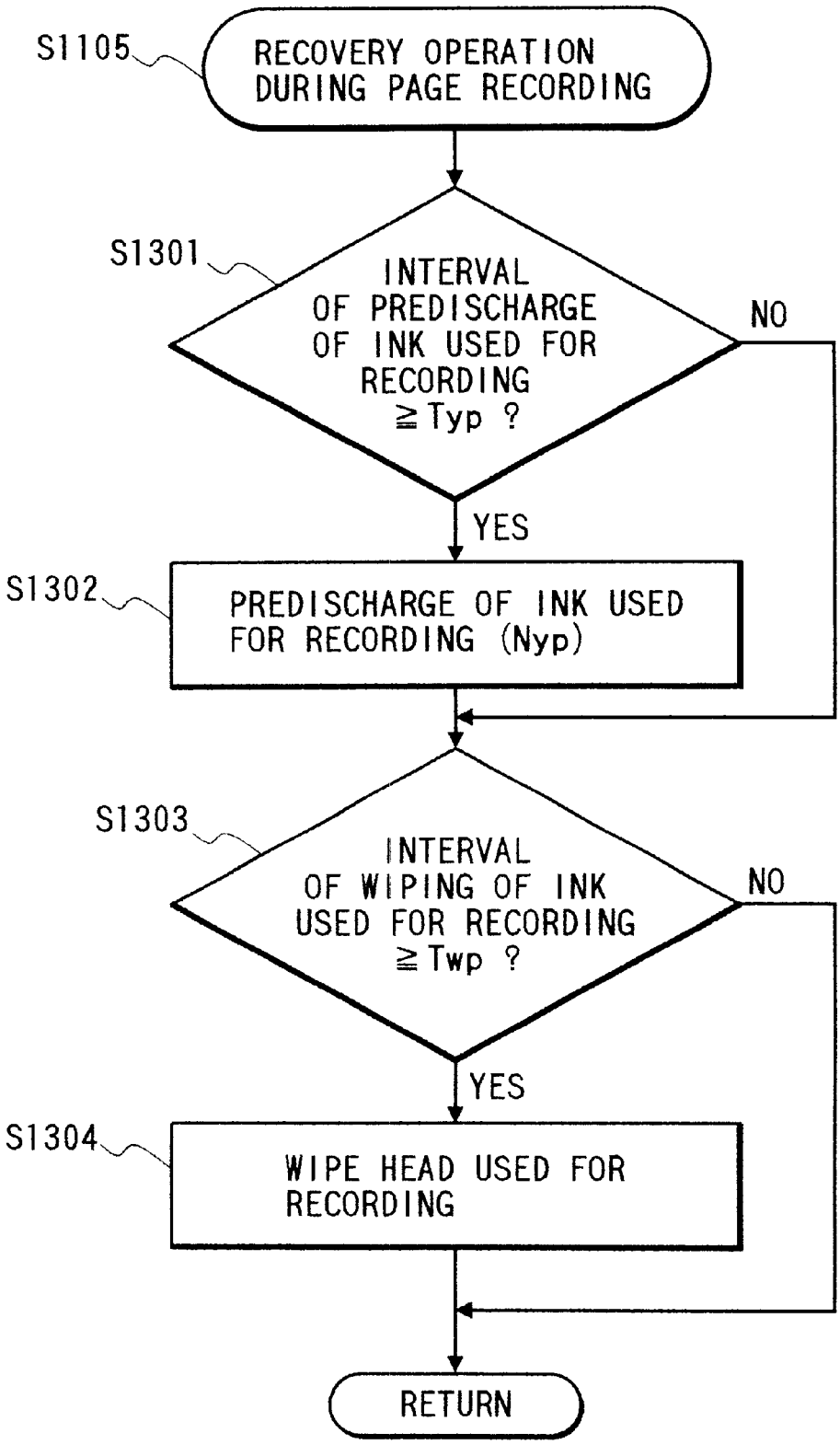
FIG. 13 is a flowchart showing the detailed procedure of a recovery operation during page recording as shown in FIG. 11.

FIG. 13 shows the detailed procedure of recovery process during page recording according to the present invention at step S1105 as shown in FIG. 11.

First, at step S1301, a determination is made whether or not the elapsed time from the previous predischarge of that ink is equal to or greater than Typ, with an array of discharge ports of the recording head 1 being currently used for recording. And if the result of determination herein is affirmative, the procedure proceeds to step S1302 to predischarge the ink in use for recording by a predetermined amount of ink Nyp, and then to step S1303. Also, if the result of determination at step S1301 is negative, the procedure bypasses step S1302 and proceeds to step S1303. At step S1303, a determination is made whether or not the elapsed time from the previous wiping for the recording head 1 used for recording is equal to or greater than Twp. And if the result of determination at step S1303 is affirmative, the procedure proceeds to step S1304 to wipe the recording head 1 used for recording, and is ended. Also, if the result of determination at step S1303 is negative, the procedure bypasses step S1304 and is ended.

Owing to such recovery process during page recording S1105, the recording head 1 during page recording for which the line recording is repeated is allowed to excellently perform the recording without consuming wastefully the ink not involved in recording upon the recovery operation, while preventing the occurrence of non-discharge due to ink evaporation from the discharge ports, or sticking of ink mist, paper powder or dust onto the discharge port face.

Figure 14:
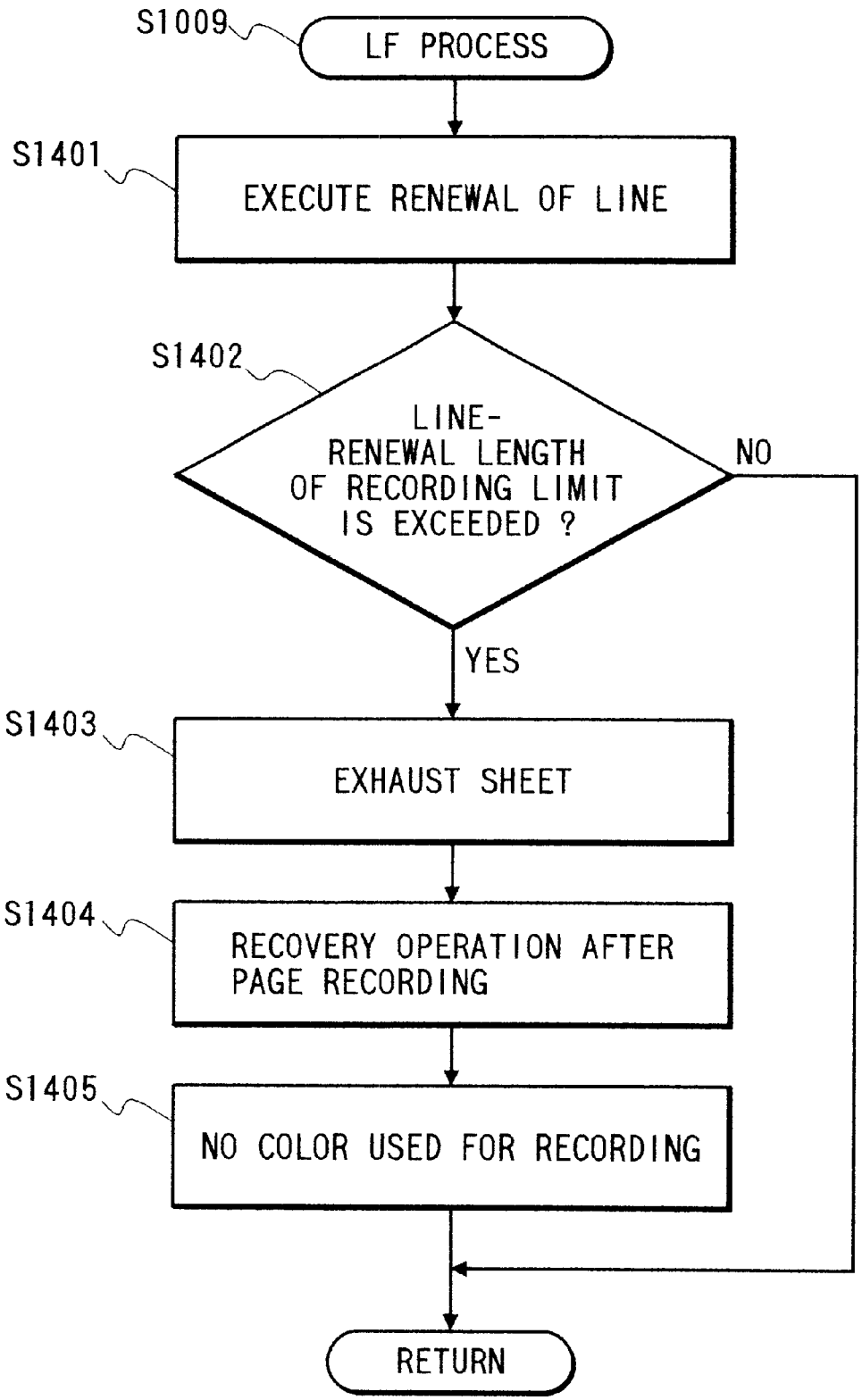
FIG. 14 is a flowchart further showing the detailed procedure of an LF process as shown in FIG. 10.

FIG. 14 shows the detailed procedure of LF process at step S1009 as shown in FIG. 10.

First, at step S1401, the recording sheet 10 is fed by a predetermined amount set by the command or with designation of the recording mode. And at step S1402, a determination is made whether or not the line-renewal length of recording limit is exceeded. The line-renewal length of recording limit can be obtained based on the length of recording sheet 1 set by the command, or upon the detection of the bottom end of the recording sheet 10 by the sheet detection sheet sensor 20 provided in the ink jet recording apparatus. If the result of determination at step S1402 is affirmative, the procedure proceeds to step S1403 to exhaust the recording sheet 10. And the procedure proceeds to step S1404 to perform recovery operation after page recording, and to step S1405 to set a flag indicating no color used for recording, and then is ended. Note that if the result of determination at step S1402 is negative, the processing is ended.

Figure 15:
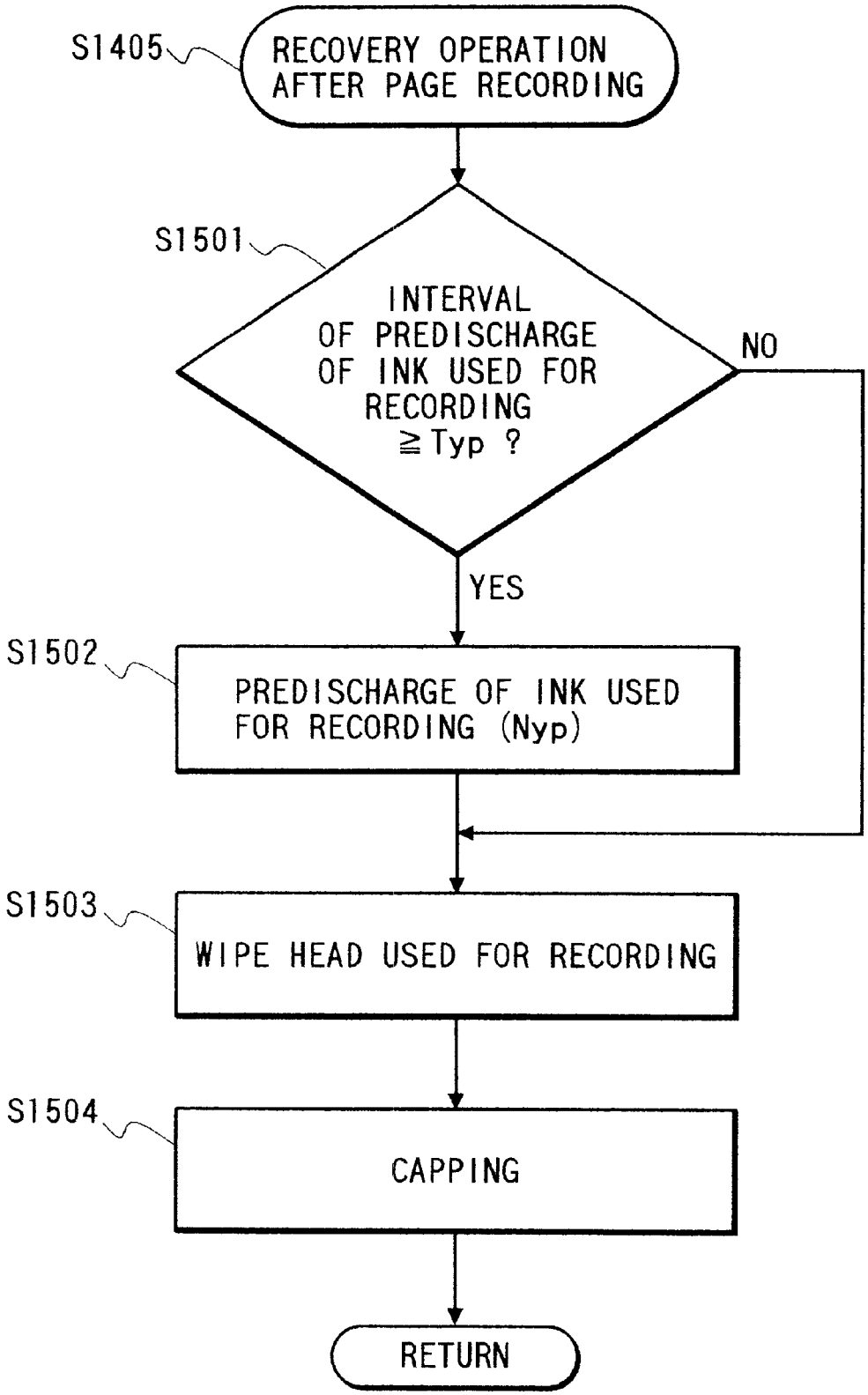
FIG. 15 is a flowchart further showing the detailed procedure of a recovery operation after page recording as shown in FIG. 14.

FIG. 15 shows the details of recovery operation processing procedure after page recording according to the present invention at step S1405 as shown in FIG. 14. For the recording operation after page recording S1405, first at step S1501, a determination is made whether or not the elapsed time from the previous predischarge of ink is equal to or greater than Typ, with an array of ink discharge ports for the recording head 1 in current use for recording. And if the result of determination is affirmative, the procedure proceeds to step S1502 to predischarge the ink used for recording by a predetermined amount Nyp, and to step S1503. Also, if the result of determination at step S1301 is negative, the procedure bypasses step S1502 and proceeds to step S1503. At step S1503, the wiping of the recording head 1 used in recording is performed, and the procedure proceeds to step S1504. And at step S1504, the recording head 1 is capped and the procedure is ended.

Owing to such recovery process after page recording S1405, it is possible to remove the cause of discharge failure of the recording head 1 due to evaporation of the ink from the discharge ports in the cap open state, or sticking of ink mist, paper powder, or dust onto the discharge port face, without consuming wastefully the ink not involved in recording upon the recovery operation, and prevent the non-discharge due to being left away for the long time in the capped state.

Figure 16:
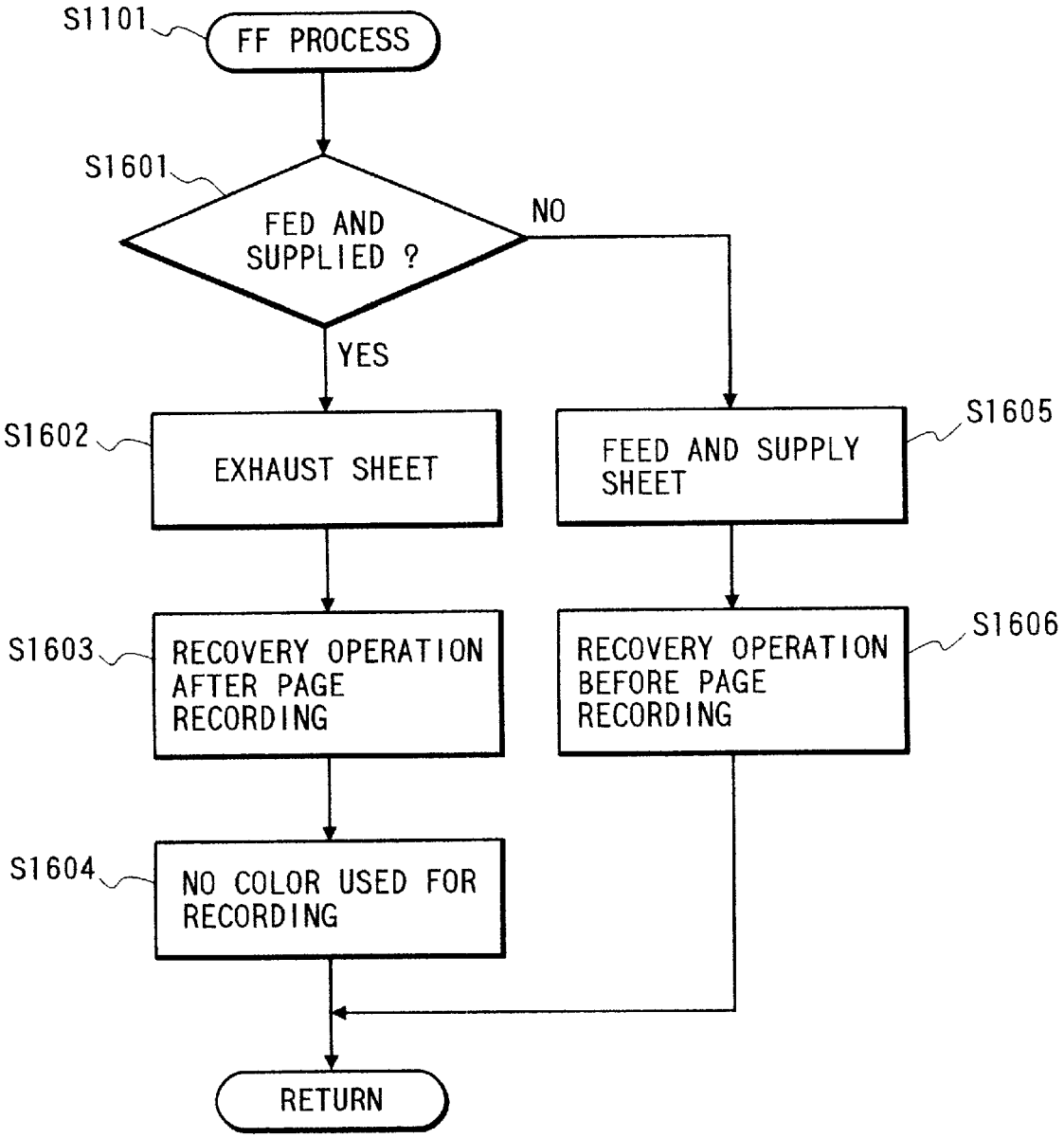
FIG. 16 is a flowchart further showing the detailed procedure of an FF process as shown in FIG. 10.

FIG. 16 shows the detailed procedure of FF process by an exhaust command at step S1011 as shown in FIG. 10. In the FF process S1011, first at step S1601, a determination is made whether or not the sheet has been fed and supplied. And if the result of determination is affirmative, the procedure proceeds to step S1602 to exhaust the recording sheet 10. The steps following this step S1602 correspond to those following the step S1403 of FIG. 14. That is, at the next step S1603, the recovery operation after page recording is performed, and at step S1604, a flag indicating no color used for recording is set up, and the procedure is ended. Also, if the result of determination at step S1601 is negative, the procedure proceeds to step S1605 to feed and supply the recording sheet 10. Note that step S1605 corresponds to S1102 of FIG. 11. Thus, at step S1606, the recovery operation before page recording is performed and the procedure is ended.

As above described, with this example, the recording can be excellently effected without wastefully consuming the ink not involved in the recording upon the recovery operation for the recording head during the recording. Also for the ink not involved in recording, the excellent recording condition can be retained by the periodical recovery processing as shown in FIG. 5.

SECOND EXAMPLE

Figure 17:
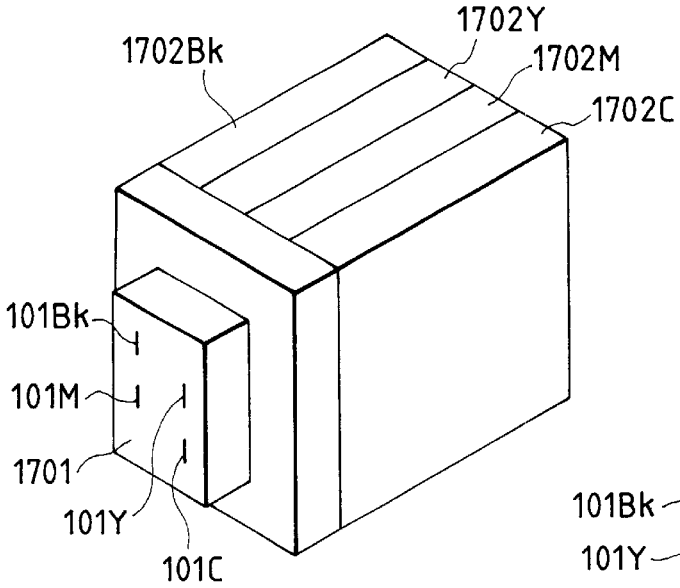
FIG. 17 is a perspective view illustrating the constitution of a recording head ink cartridge according to a second example of the present invention.
Figure 18:
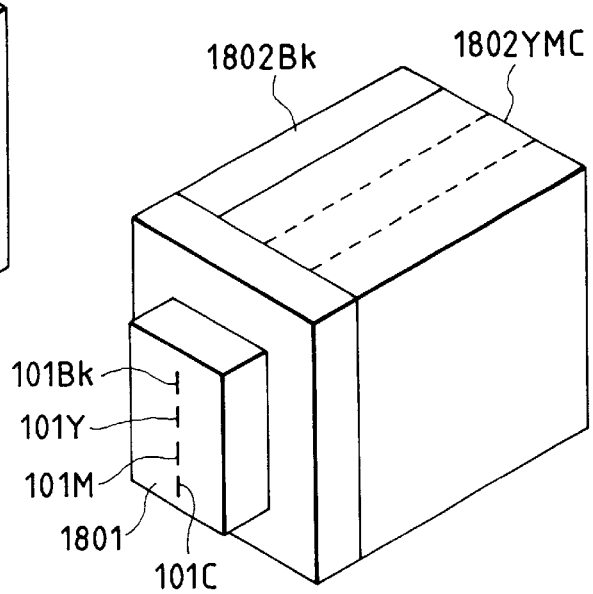
FIG. 18 is a perspective view illustrating the constitution of a recording head ink cartridge according to the second example of the present invention.
Figure 19:
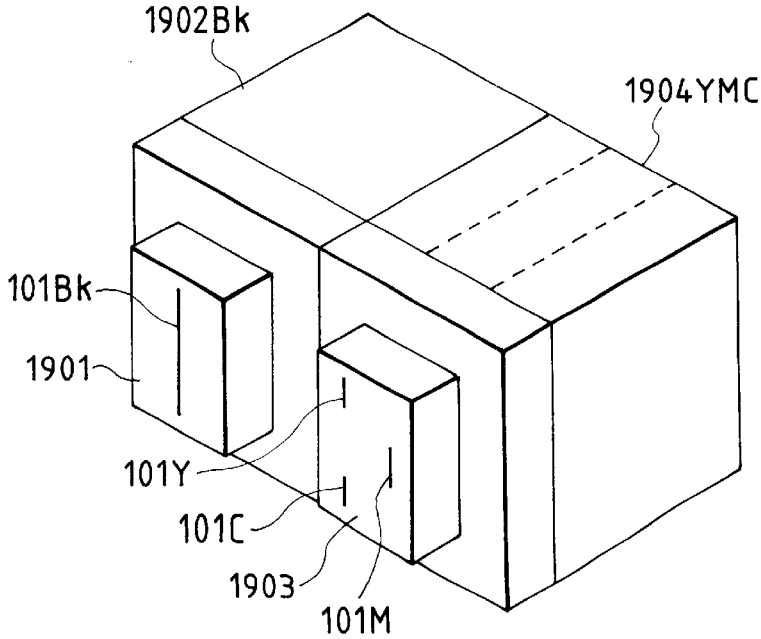
FIG. 19 is a perspective view illustrating the constitution of a recording head ink cartridge according to the second example of the present invention.

FIGS. 17, 18 and 19 illustrate the constitution of a recording head and an ink cartridge according to another example of the present invention.

FIG. 17 exemplifies one constitution in which a recording head 1701 is commonly employed for BK, Y, M and C inks, with discharge port columns 101BK, 101Y, 101M and 101C separately provided. The ink cartridges 1702BK, 1702Y, 1702M and 1702C can be exchanged independently of one another. By having the recording head 1701 integrally formed in this way, the recording head can be manufactured inexpensively. Also, where a cap member is commonly provided for all the ink discharge ports in the recording head 1701, the suction of the ink can not be made independently of other inks. Also, the wiping of the ink can not be made independently. However, the use of the recovery process of the present invention makes it possible to effect the excellent recording, with good preservation when out of service, without consuming wastefully the ink not involved in recording upon the recovery operation by predischarge during recording.

FIG. 18 exemplifies another constitution in which a recording head 1801 is commonly employed, with discharge port columns 101BK to 101C separately provided. Also, the ink tanks Y, M, C are incorporated into an integral cartridge 1802YMC, and only a BK ink tank is made a separate cartridge 1802BK. Similarly, by constituting the recording head 1801 as one piece, the recording head can be manufactured cheaply. Also, when a cap member is commonly provided for all the ink discharge ports in the recording head, the suction of the ink, as well as the wiping, can not be made independently of other inks, but because the frequency of using the BK ink in the normal recording condition is higher than that of using YMC inks, the use of a head unit of this example makes it possible to effect the excellent recording, with good preservation when out of service, without consuming wastefully the Y, M, C inks which have relatively lower use frequency upon the recovery operation by predischarge during recording with only the BK ink.

Also, when an integral cartridge for the BK, Y, M, C inks is provided, it is possible to eliminate the waste produced in the recovery operation by predischarge during recording.

FIG. 19 exemplifies another constitution in which a BK ink recording head 1901 and an YMC ink recording head 1902 are provided separately. In this case, the cap members are individually provided for the recording heads 1901, 1902 to allow for the individual suction. Accordingly, it is possible to effect the excellent recording, with good preservation when out of service, without consuming wastefully the Y, M, C inks having lower use frequency upon the recovery operation by suction or predischarge during recording.

THIRD EXAMPLE

Figure 20:
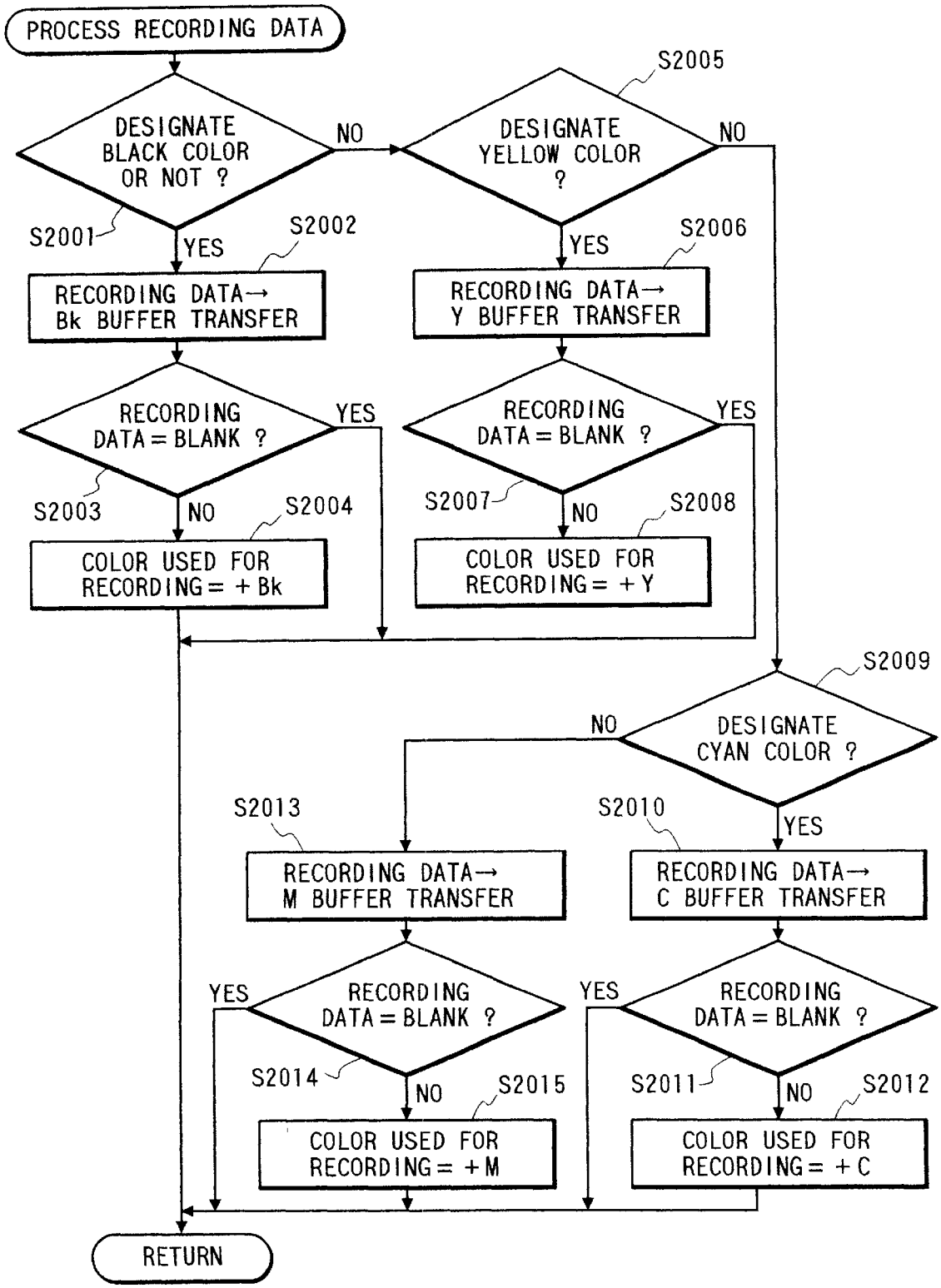
FIG. 20 is a flowchart showing the procedure of a control operation according to a third example of the present invention.

While in the first example, the ink for use within the page was specified before page recording by a command, it will be understood that when an information processing device is integrated with the ink jet recording apparatus, it is easy to check the recording data and discriminate the ink used for the recording. However, when the ink jet recording apparatus is controlled by received data from the host side, the host side must check recording data, determine the ink actually used for the recording, and send a command indicating the use color to the ink jet recording apparatus. When only the BK ink is used, the check for recording data is simple, but the discrimination of the ink actually used from color recording data impose great burden on the host side, because of a large amount of recording data. FIG. 20 shows a control operation procedure for analyzing the recording data in the ink jet recording apparatus itself and discriminating the ink actually used for the recording without specification by the command from the host side. In the case of normal color recording data, it is almost common that after the command for designating the color, recording data appears in succession, to correspond to the recording data process as shown at step S1005 in FIG. 10.

First, at step S2001, a color designating command for recording data is checked. When the designation at step S2001 is BK or none, the procedure proceeds to step S2002. And at step S2002, recording data is transferred to a BK line buffer 206BK (see FIG. 2A). Then at step S2003, a determination is made whether or not recording data is blank (white). That is, as shown in FIG. 2A, an effective dot counter 208BK is provided in front of the BK line buffer 206BK and can count the effective number of data from the recording data. Thus, it is determined that if the value of the effective dot counter 203BK is zero, the black ink is not used, while if it is one or greater, the black ink is used. If the result of determination at step S2003 is negative, the procedure proceeds to step S2004 to add black to the recording colors to be used, and is ended. Also, if the result of determination at step S2003 is affirmative, the procedure is directly ended. Thus, the similar processings are performed for the recording data color designation commands for Y, M, and C.

That is, if the color designation is Y at step S2005, the procedure from step S2006 to step S2008 is followed, while if the color designation is C at step S2009, the procedure from step S2101 to S2012 is followed. If the determination is negative at step S2009, the color designation is supposed as M, and the processing is made following the procedure from step S2013 to S2015.

Accordingly, without burden on the host side, the ink jet recording apparatus can discriminate the ink to be used for the recording, and allows the excellent recording, with good preservation when out of service, without consuming wastefully the ink not involved in recording upon the recovery operation by suction or predischarge during recording.

While in the third example, recording data was provided in succession after the color designation command, it will be appreciated that when recording data is received in dot sequence, the recording data may be transferred to the line buffer for each color in units of dot, with the effective dot counter provided in front of the line buffer, whereby the ink used for the recording can be discriminated by checking the content of the effective dot counter, with the same effect obtained.

Also, while in the first example, the ink used for the recording is discriminated in units of page, it will be appreciated that the ink used for the recording may be discriminated in units of job extending over several pages.

When using a plurality of inks having different densities with the same color tone, the same processing may be made with less wasteful consumption of the ink, by discriminating the ink not to be used with the designation of the recording mode.

Regarding the color information, the ink used for the recording can be discriminated for not only YMCK but also other descriptions such as RGB, HSV, Lab, XYZ by checking the color used or not used in the YMCK in the process of transformation into YMCK information, with the same effect obtained.

According to the present invention, the excellent recording, with good preservation when out of service, can be made without consuming wastefully the ink not involved in recording upon the recovery operation by ink suction or predischarge from the recording head used during recording.

Also, when the recording head or ink cartridge is not provided separately for each ink color, the excellent recording, with good preservation when out of service, can be effected without consuming wastefully the ink upon the recovery operation by ink suction or predischarge from the recording head used during recording.

Furthermore, the excellent recording, with good preservation when out of service, can be made without consuming wastefully the ink upon the recovery operation by ink suction or predischarge as above mentioned, without burden on the host information processing device.

What is claimed is:

1. An ink jet recording apparatus comprising:

first recovery means for recovering performance of discharge from a plurality of ink discharge ports which respectively discharge a plurality of different inks for recording;

second recovery means for recovering performance of discharge from said plurality of ink discharge ports; and control means for controlling the apparatus such that said first recovery means performs a first recovery for a discharge port for discharging the ink to be used for recording which is selected from among said plurality of inks if an interval of recovery for said ink discharge port for discharging the ink to be used for recording reaches a predetermined time, and said second recovery means performs a second recovery, independent of said first recovery, for said plurality of ink discharge ports if an electrical power switch for the apparatus is turned on and a time elapsed from a preceding recovery by said second recovery means reaches another predetermined time.

2. An ink jet recording apparatus according to claim 1, wherein said control means controls the apparatus such that the content of recovery by said second recovery means is less in magnitude than the content of recovery by said first recovery means.

3. An ink jet recording apparatus according to claim 1, wherein said second recovery means discharges ink from said ink discharge ports not used for recording.

4. An ink jet recording apparatus according to claim 1, wherein said first recovery means sucks ink from said ink discharge ports used for recording.

5. An ink jet recording apparatus according to claim 1, wherein said first recovery means wipes said ink discharge ports used for recording.

6. An ink jet recording apparatus according to claim 1, further comprising detecting means for detecting whether or not a plurality of different inks will be used for the recording, and for outputting a detection result to said control means.

7. A recovery method for recovering performance of discharge from a plurality of ink discharge ports which respectively discharge a plurality of different inks for recording, comprising:

a first recovery step for performing recovery for an ink discharge port for discharging the ink to be used for recording which is selected from among said plurality of inks if an interval of recovery for said ink discharge port for discharging the ink to be used for recording reaches a predetermined time; and a second recovery step independent of said first recovery step for performing recovery for said plurality of ink discharge ports if an electrical power switch for the apparatus is turned on and a time elapsed from a preceding recovery by said second recovery means reaches another predetermined time.

8. A recovery method according to claim 7, wherein in said first and second recovery steps, the content of recovery from said second recovery step is less in magnitude than the content of recovery from said first recovery step.

9. A recovery method according to claim 7, wherein said second recovery step includes discharging ink from ink discharge ports not used for recording.

10. A recovery method according to claim 7, further including sucking ink from said discharge ports in said first and second recovery steps.

11. A recovery method according to claim 7, further including wiping said discharge ports in said first and second recovery steps.

12. A recovery method according to claim 7, wherein heat energy is used to discharge ink from said discharge ports.

13. An ink jet recording apparatus according to claim 1, wherein said second recovery means sucks ink from said plurality of ink discharge ports.

* * * * *

UNITED STATES PATENT AND TRADEMARK OFFICE

CERTIFICATE OF CORRECTION

PATENT NO. : 6,536,866 B1
DATED : March 25, 2003
INVENTOR(S) : Uchikata

It is certified that error appears in the above-identified patent and that said Letters Patent is hereby corrected as shown below:

Drawings,
Sheet 16, "S1405" in FIG. 15 should read -- S1404 --.
Sheet 17, "S1101" in FIG. 16 should read -- S1011 --.

Column 4,
Lines 14 (both occurrences), 16, 36 and 37 (second occurrence), "the" should be deleted; and
Line 41, "each" should read -- after each --.

Signed and Sealed this

Eighteenth Day of November, 2003

JAMES E. ROGAN
*Director of the United States Patent and Trademark Office*